US010215486B2

(12) United States Patent
Akiyama et al.

(10) Patent No.: US 10,215,486 B2
(45) Date of Patent: Feb. 26, 2019

(54) LIQUEFIED GAS PRODUCTION FACILITY

(71) Applicant: JGC CORPORATION, Kanagawa (JP)

(72) Inventors: Keiji Akiyama, Kanagawa (JP); Yoshihisa Wakamatsu, Kanagawa (JP); Naoyuki Takezawa, Kanagawa (JP); Takahiro Kitabayashi, Kanagawa (JP); Masahito Seiwa, Kanagawa (JP); Yuzuru Kakutani, Kanagawa (JP); Takashi Hirata, Kanagawa (JP); Kei Kubota, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 195 days.

(21) Appl. No.: 14/655,405

(22) PCT Filed: Dec. 27, 2013

(86) PCT No.: PCT/JP2013/007682
§ 371 (c)(1),
(2) Date: Jun. 25, 2015

(87) PCT Pub. No.: WO2014/103332
PCT Pub. Date: Jul. 3, 2014

(65) Prior Publication Data

US 2015/0354887 A1 Dec. 10, 2015

(30) Foreign Application Priority Data

Dec. 28, 2012 (JP) ..... 2012-288965

(51) Int. Cl.
*F25J 1/00* (2006.01)
*F25J 1/02* (2006.01)
(Continued)

(52) U.S. Cl.
CPC ..... *F25J 1/0022* (2013.01); *F25J 1/0259* (2013.01); *F25J 1/0269* (2013.01); *F25J 1/0296* (2013.01); *F28B 1/06* (2013.01); *C10L 3/06* (2013.01)

(58) Field of Classification Search
CPC ..... F25J 1/0022; F25J 1/0259; F25J 1/0269; F25J 1/0296; F25J 1/0052; F25J 1/0057;
(Continued)

(56) References Cited

U.S. PATENT DOCUMENTS

2006/0150671 A1 7/2006 Lijima et al.
2008/0307826 A1* 12/2008 Coward ..... F25J 1/0022 62/611
(Continued)

FOREIGN PATENT DOCUMENTS

JP 2000-346402 A 12/2000
JP 2005-147568 A 6/2005
(Continued)

OTHER PUBLICATIONS http://www.energyworldcorp.com/moudlar.html ; Energy World Corp Australia's LNG Plant; Jul. 23, 2011.*
(Continued)

*Primary Examiner* — Keith Raymond
(74) *Attorney, Agent, or Firm* — Osha Liang LLP

(57) ABSTRACT

A liquefied gas production facility includes a plurality of liquefied gas producers which produce liquefied gas by removing an unnecessary substance and liquefying feed gas containing methane as a main component.

6 Claims, 26 Drawing Sheets

(51) Int. Cl.
*F28B 1/06* (2006.01)
*C10L 3/06* (2006.01)

(58) Field of Classification Search
CPC ..... F25J 1/0272; F25J 1/0257; F28B 1/06; G01W 1/10
See application file for complete search history.

(56) References Cited

U.S. PATENT DOCUMENTS

| | | | | |
|---|---|---|---|---|
| 2009/0056413 | A1 | 3/2009 | Rao et al. | |
| 2014/0053599 | A1* | 2/2014 | Byfield | F28B 1/06 62/611 |

FOREIGN PATENT DOCUMENTS

| | | | | |
|---|---|---|---|---|
| JP | 2005-283202 | A | | 10/2005 |
| JP | 2005283202 | A | * | 10/2005 |
| JP | 2009-062983 | | | 3/2009 |
| JP | 2010-060443 | A | | 3/2010 |
| WO | 20071112498 | A1 | | 10/2007 |

OTHER PUBLICATIONS

Atlantic LNG Train 4 "The World's Largest LNG Train"; Diocee et al. LNG 14 Doha, Qatar, Mar. 2004.*
"Chapter 16 Airflow around Buildings", ASHRAE Fundamentals Handbook—Chapter 16, pp. 16.1-16.12.*
"Cameron LNG Liquefaction Project", Cameron LNG, Oct. 17, 2012.*
"Environmental Assessment for the Sabine Pass Liquefaction Project"; Sabine Pass Liquefaction, LLC; Dec. 22, 2011.*
Tanabe et al. "Forced Ventilation effect by Air-Fin-Cooler in modularized onshore LNG plant", Sep. 2012.*
Cameron LNG, "Submittal of Draft Resource REport 11", JD Morris, Oct. 17, 2012 (Figure 11.6-2).*
"Energy Efficient LNG Production", Wiguna et al. (presenteed at GasTech London), Oct. 2012.*
International Preliminary Report on Patentability and Written Opinion issued in corresponding International Application No. PCT/JP2013/007682 dated Jul. 9, 2015, and English translation thereof (8 pages).
International Search Report in corresponding International Application No. PCT/JP2013/007682 dated Apr. 8, 2014, and English translation thereof (1 page).
Masafumi Kawai, "Thermal diffusion of an air fin cooler—Recirculation phenomena and their features-", Haikan Gijutsu, Dec. 1, 1994 (Dec. 12, 1994), vol. 36, No. 14, pp. 96 to 100 (7 pages).
Tony S. Diocee et al., Atlantic LNG Train 4 "The World's Largest LNG Train", Mar. 15, 2004, Doha, Qatar.†
Google Earth image of 10°10'47.72"N 61°41'28.59"W, 1, Date of Retrieval: Mar. 8, 2015, https://www.google.com/maps/place/10%C2%B010'47.7%22N+61%C2%B041'28.6%22W/@10.1807831,-61.6913272,1479a,20y,90h/data=!3m1!1e3!4m5!3m4!1s0×0:0×0!8m2!3d10.1799222!4d-61.691275.†
Draft Resource Report 11 Cameron LNG Liquefaction Project Cameron LNG, 163, Oct. 2012, FERC Online at http://elibrary.ferc.gov/idmws/common/OpenNat.asp?fileID=13091697.†
Yoshihide Tominaga et al., Development of a system for predicting snow distribution in built-up environments: Combining a mesoscale meteorological model and a CFD model, 9, Jan. 13, 2011, Journal of Wind Engineering and Industrial Aerodynamics.†
William J. Coirier et al., Progress Towards a Coupled Mesoscale and Microscale Modeling Capability, 9, Sep. 11, 2007, The Seventh Conference on Coastal Atmospheric and Oceanic Prediction and Processes joint with the Seventh Symposium on the Urban Environment (Sep. 10-13, 2007) (San Diego, CA) and at https://ams.confex.com/ams/7Coastal7Urban/techprogram/programexpanded_429.htm.†
Y.S. Liu et al., Study on micro-atmospheric environment by coupling large eddy simulation with mesoscale model, 12, May 4, 2012, Journal of Wind Engineering and Industrial Aerodynamics.†
Andrzej A. Wyszogrodzki et al., Evaluation of the coupling between mesoscale-WRF and LES‐EULAG models for simulating fine-scale urban dispersion, 22, Nov. 15, 2012, Atmospheric Research.†
L.J. Yang et al., Trapezoidal array of air-cooled condensers to restrain the adverse impacts of ambient winds in a power plant, 12, Jun. 30, 2012, Applied Energy.†
Koichi Kawana, LNG Liquefaction Project—Variety & Innovation—, 12, Sep. 19, 2012, LNG Producer-Consumer Conference 2012 and at http://aperc.ieej.or.jp/file/2012/12/28/S4_06jgc.pdf.†
Ryoji Ogiso et al., Advanced CAE Applications for LNG Plant Design, 8, Apr. 2, 2013, http://www.gastechnology.org/Training/Documents/LNG17-proceedings/Process-2-Ryoji_Ogiso.pdf.†
Siti Farhana Bt M Shaari et al., Understanding of Hot Air Recirculation Phenomena in Air-Cooled Base Load LNG Plant, 15, Mar. 26, 2013, http://www.gastechnology.org/Training/Documents/LNG17-proceedings/Materials-6-Siti_Farhana_M_Shaari.pdf.†

* cited by examiner
† cited by third party

FIG.17B

801

| TIME | WIND DIRECTION | WIND SPEED | TURBULENCE ENERGY | SOLAR RADIATION | ATMOSPHERIC PRESSURE | PRECIPI-TATION | HUMI-DITY | TEMPER-ATURE |
|---|---|---|---|---|---|---|---|---|
| Time 1 | N | 3 | · | 1.0 | 980 | 0 | 70 | 31.1 |
| Time 2 | · | · | · | · | · | · | · | 32.2 |
| Time 3 | · | · | · | · | · | · | · | · |
| Time 4 | · | · | · | · | · | · | · | · |
| · | · | · | · | · | · | · | · | · |
| · | · | · | · | · | · | · | · | · |
| · | · | · | · | · | · | · | · | · |

LIQUEFIED GAS PRODUCTION FACILITY

TECHNICAL FIELD

The present invention relates to a liquefied gas production facility.

BACKGROUND ART

Liquefied gas production facilities are facilities for producing liquefied natural gas by refining and liquefying liquefied natural gas (LNG), liquefied petroleum gas (LPG), and synthetic natural gas (SNG), which are natural gases. Examples of liquefied gas production facilities include an LNG production facility, an LPG production facility, and an SNG production facility.

FIG. 1 is a functional block diagram illustrating an example of an LNG production facility. Gas supplied from a gas field is fed to the LNG production facility after a liquid separation process. In the LNG production facility, LNG is produced by the steps of, for example, removal of mercury from the gas, acid gas removal, moisture removal, liquefaction, and nitrogen removal.

A refrigerant used in the liquefaction step is circulated by a vapor compression refrigeration cycle. In the refrigeration cycle, a gas refrigerant is compressed by a compressor, and the compressed refrigerant is cooled by a condenser, so that the refrigerant is liquefied. Then, the pressure and temperature of the refrigerant are reduced by an expansion valve or the like, and the refrigerant is caused to exchange heat with natural gas, so that the gas refrigerant is generated again. Thus, the natural gas is liquefied by the refrigeration cycle that utilizes power of the compressor and heat exchange in the condenser.

Refrigeration cycles of LNG production facilities include water-cooling or air-cooling condensers. Water-cooling condensers often use seawater to cool cooling water. However, the influence of the seawater heated as a result of heat exchange raises environmental concerns, and the number of LNG production facilities including air-cooling condensers has recently increased.

The liquefaction step is essential not only in LNG production facilities but also in LPG production facilities and SNG production facilities.

As illustrated in FIGS. 1 and 2 of PTL 1, an LNG production facility is generally configured such that a pipe rack is arranged in a central area of the facility and that compressors, heat exchangers for cooling natural gas, a distillation column for refining the natural gas, etc., are arranged on both sides of the pipe rack. In an LNG production facility including an air-cooling condenser, a plurality of air fin coolers (referred to also as "AFCs") are arranged at the top of the pipe rack.

In the LNG production facility, the air fin coolers are arranged at least along a single straight line so as to form a rectangular shape as a whole. The LNG production facility has a rectangular shape as a whole since facilities related thereto are arranged on both sides of the pipe rack having the air fin coolers at the top.

In recent years, the size of LNG production facilities has been increased. Accordingly, one or two LNG production facilities are generally constructed at the initial stage of a project, and another LNG production facility (facilities) is additionally constructed in accordance with the increase in demand. The LNG production facilities that are constructed as necessary in accordance with the progress of the project are formed as modules of substantially the same type, and are referred to as, for example, "LNG trains", "LNG modules", or "LNG units".

In FIG. 1 of PTL 2, a plurality of LNG modules 20 are arranged next to each other.

CITATION LIST

Patent Literature

PTL 1: Japanese Unexamined Patent Application Publication No. 2005-147568

PTL 2: International Publication No. 2007/112498

The LNG modules 20 illustrated in FIG. 1 of PTL 2 are arranged next to each other in a longitudinal direction so as to form a rectangular shape as a whole.

FIG. 2 illustrates an example of an arrangement of LNG plants. LNG facilities 1000A to 1000C illustrated in FIG. 2 are arranged next to each other in a longitudinal direction to form a rectangular shape 1100 as a whole.

This is because since LNG production facilities have a rectangular shape as described above, the area for the LNG plants (area denoted by 1100 in FIG. 2) is formed in a rectangular shape to reduce cost by minimizing the area in which the LNG production facilities are arranged.

FIG. 3 is a plan view illustrating the effects caused by hot air that flows between LNG production facilities. The air fin coolers of the LNG production facilities include fans in an upper section thereof. Cold air is sucked in from a lower section by the fans, and is caused to exchange heat with hot fluid that flows through tubes. Then, hot air is discharged from the upper section. However, as illustrated in FIG. 3, the LNG train 1000A, which includes an air-cooling condenser, sucks in the hot air (denoted by 1200 in FIG. 3) discharged from the adjacent LNG train 1000B, and the amount of LNG production decreases as a result. The phenomenon where the hot air discharged from an air fin cooler of a train is sucked in by another air fin cooler of the same train is called hot air recirculation (HAR). A similar phenomenon that occurs between different trains is called "external HAR" since the hot air from an external train is sucked in.

FIG. 4 is a sectional view illustrating the effects caused by the hot air that flows between the LNG production facilities. Owing to the cross wind that blows from an LNG train B, the air discharged from the air fin coolers of the LNG train B is sucked into an LNG train A (external recirculation). Accordingly, the amount of LNG production of the LNG train A is reduced.

FIG. 5 is a graph showing the relationship between the increase in the inlet temperature of the air fin coolers and the amount of LNG production. FIG. 5 shows the measured values of the amount of production of an LNG production facility. When the inlet temperature of the air fin coolers is 28.5° C., the amount of LNG production may be 470 [ton/h]. When the inlet temperature is increased to 31.5° C., the amount of production is reduced to 370 [ton/h]. Thus, the increase in inlet temperature caused by the external HAR has a large influence on the productivity of the LNG production facility.

SUMMARY OF INVENTION

One or more embodiments of the invention provide the following.

A liquefied gas production facility according to one or more embodiments of the present invention includes a plurality of liquefied gas production units (or "liquefied gas producers") which produce liquefied gas by removing an unnecessary substance and liquefying feed gas containing methane as a main component.

Each liquefied gas production unit includes a heat exchanger that cools the feed gas by causing the feed gas to exchange heat with a refrigerant, a compressor that compresses the refrigerant that is evaporated as a result of the heat exchange with the feed gas, an air fin cooler unit that cools the compressed refrigerant, and an expander unit (or "expander") that cools the cooled refrigerant through adiabatic expansion.

The air fin cooler unit includes a plurality of air fin coolers that are arranged along at least one straight line so as to form a first rectangular shape as a whole. In each liquefied gas production unit, each of the heat exchanger, the compressor, and the expander unit is arranged at a side of the air fin cooler unit in a longitudinal direction of the first rectangular shape so as to form a second rectangular shape as a whole.

When two of the liquefied gas production units that are adjacent to each other are first and second liquefied gas production units, the first and second liquefied gas production units are arranged so as to be shifted from each other in a longitudinal direction of the second rectangular shape.

As a result, reduction in the amount of LNG production due to external HAR can be significantly improved.

In a conventional liquefied gas production facility, to reduce the cost by minimizing the area in which the production facility is located, a plurality of liquefied gas production units are arranged in parallel so that the liquefied gas production facility has a rectangular shape as a whole. Therefore, there has been no arrangement according to one or more embodiments of the present invention in which, among the liquefied gas production units, the first and second liquefied gas production units that are adjacent to each other are shifted from each other in the longitudinal direction of the second rectangular shape. Also, there has been no motivation to adopt such an arrangement.

LNG production facilities will be described as an example of the liquefied gas production units. The LNG production facilities are referred to also as "LNG trains", "LNG modules", or "LNG units", and correspond to LNG trains 1 to 3 illustrated in FIGS. 9 to 16 described below.

Components included in each liquefied gas production unit include, for example, a heat exchanger, a compressor, an air fin cooler unit, an expander unit, etc. and any other components that are generally included in LNG production facilities may be additionally included.

Among the liquefied gas production units, the first and second liquefied gas production units may be arranged so as to be shifted from each other in the longitudinal direction of the second rectangular shape such that hot air discharged from the air fin cooler unit of the first liquefied gas production unit does not accumulate in a space between the air fin cooler unit of the first liquefied gas production unit and the air fin cooler unit of the second liquefied gas production unit.

A ratio X/L of a distance (X) by which the first and second liquefied gas production units are shifted from each other in the longitudinal direction of the second rectangular shape to a length (L) of the first and second liquefied gas production units may be equal to or greater than 0.2, 0.5, 0.6, or 1.

In the liquefied gas production facility according to one or more embodiments of the present invention, the liquefied gas production units may be provided with respective utility facilities that are arranged at a side of the liquefied gas production units in a direction opposite to a direction in which the liquefied gas production units are shifted.

In one or more embodiments of the liquefied gas production facility according to the present invention, a ratio X/L of a distance (X) by which the first and second liquefied gas production units may be shifted from each other in the longitudinal direction of the second rectangular shape to a length (L) of the first and second liquefied gas production units is equal to or greater than 1, or 1.

In addition, the liquefied gas production units may be arranged along a single straight line that extends in the longitudinal direction of the second rectangular shape.

BRIEF DESCRIPTION OF DRAWINGS

FIG. 100 illustrates an example of a CFD analysis result showing the influence of east wind.

FIG. 17B illustrates an example of a weather information data table.

DETAILED DESCRIPTION OF EMBODIMENTS

In the following description, [1] LNG Production Facilities, [2] LNG Production Facilities Arranged in Parallel, [3] LNG Production Facilities according to one or more embodiments of the invention, [4] Temperature Increase in LNG Production Facilities according to one or more embodiments of the invention, [5] Weather Analysis Models, [6] Computational Fluid Analysis, [7] Functional Configuration and Hardware Configuration of Weather Predicting Apparatus, and [8] Reproduction of Weather Information around LNG Production Facility will be described in that order with reference to the drawings.

[1] LNG Production Facilities

Figure 6:
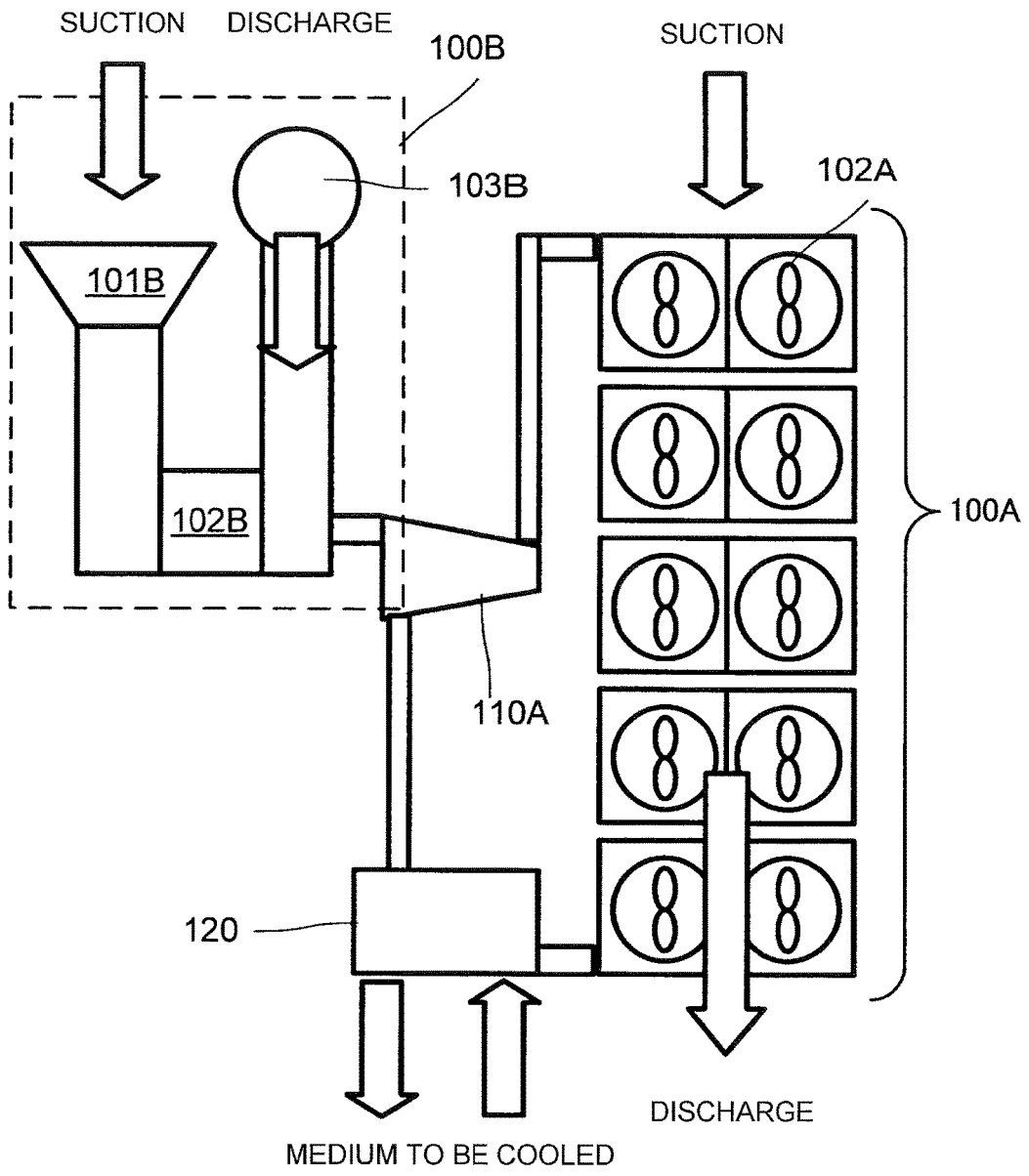
FIG. 6 illustrates examples of LNG production facilities.

FIG. 6 illustrates a specific example of LNG production facility. In FIG. 6, an air fin cooler 100A and a gas turbine 100B are illustrated as examples of LNG production facilities. The gas turbine 100B includes a suction unit (or "suction") 101B, an operation unit (or "operator") 1028, and a discharge unit (or "discharger") (smokestack) 103B. Air sucked in through the suction unit 101B is used to burn combustible gas in the operation unit 102B, so that the turbine is rotated and a driving force is generated. Thus, a compressor 110A is rotated. The exhaust gas is discharged through the smokestack 103B. The gas compressed by the compressor 110A is supplied to the air fin cooler 100A.

The air fin cooler 100A cools the gas heated by and discharged from the compressor 110A with a heat exchanger 102A by using air sucked in through a suction unit 101A (not shown) disposed in a lower section thereof, and discharges the air through a discharge unit 103A (not shown) disposed in an upper section thereof. The compressed gas cooled by the air fin cooler 100A flows into a cooling device 120, where the gas expands and the pressure thereof is reduced. Accordingly, the temperature of the gas is reduced, and a medium to be cooled is cooled. After being depressurized and heated, the gas is returned to the compressor 110A again. According to an embodiment, the medium to be cooled is, for example, hydrocarbon gas such as methane or ethane, and is liquefied by being cooled by the cooling device 120.

[2] LNG Production Facilities Arranged in Parallel

Figure 1:
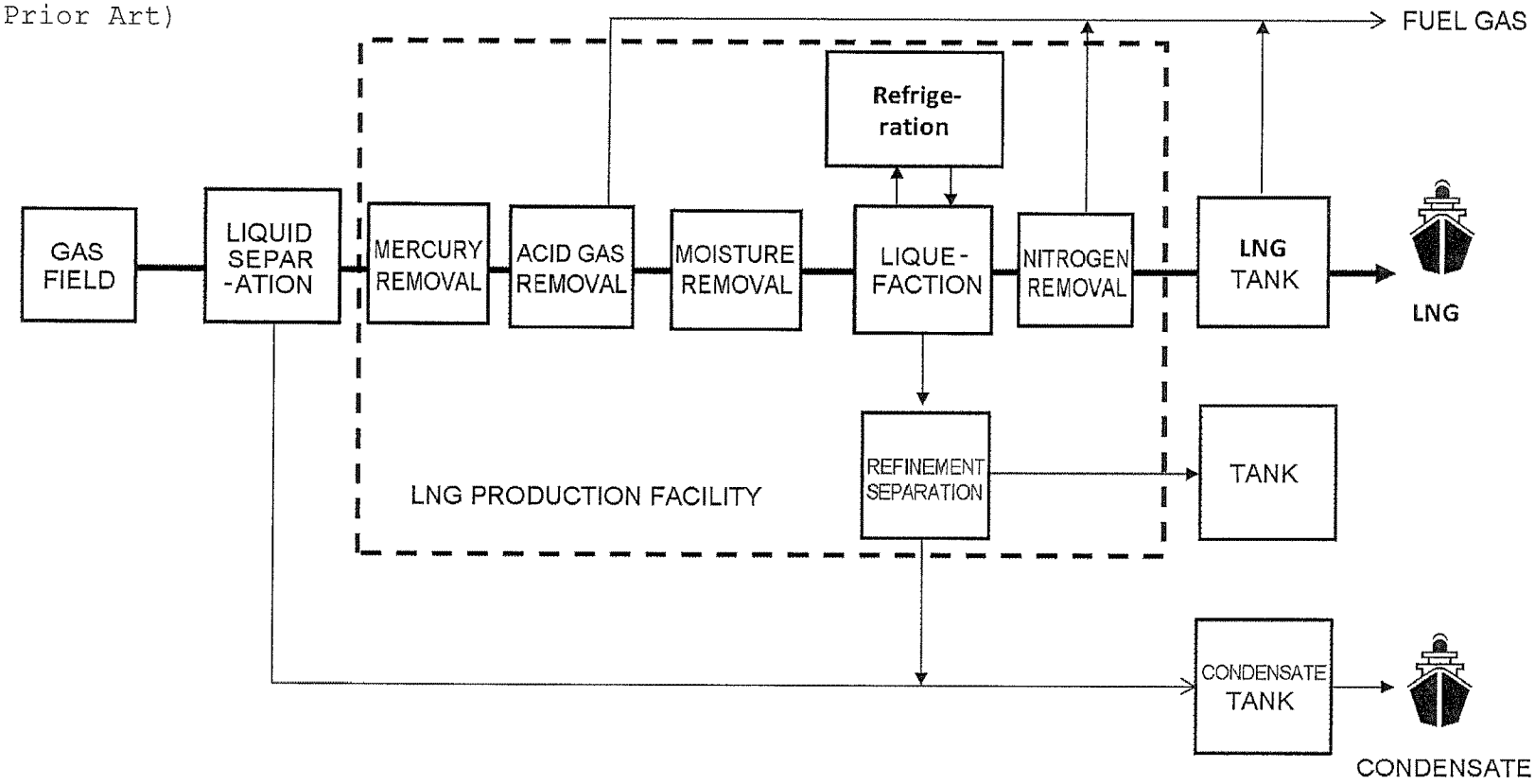
FIG.1 (Prior Art)
FIG. 1 is a functional block diagram illustrating an example of an LNG production facility.
Figure 2:
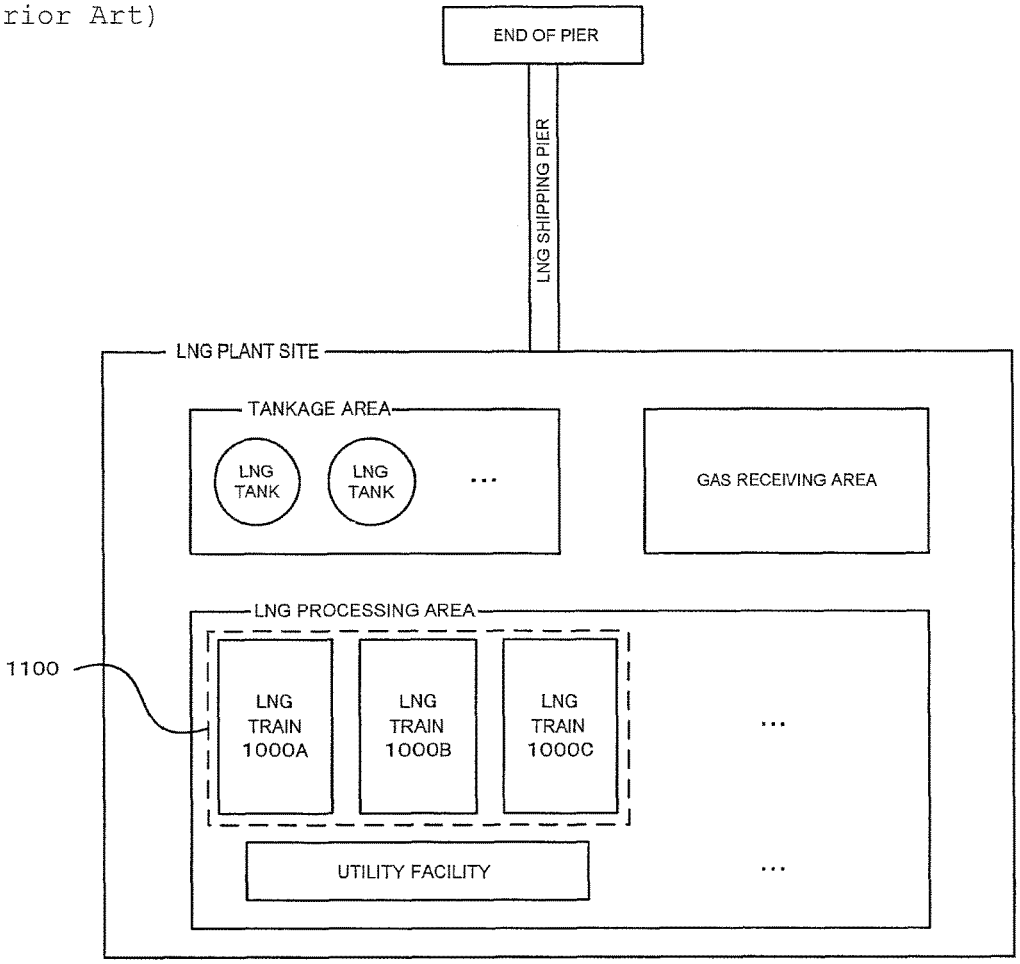
FIG.2 (Prior Art)
FIG. 2 illustrates an example of an arrangement of LNG plants.
Figure 3:
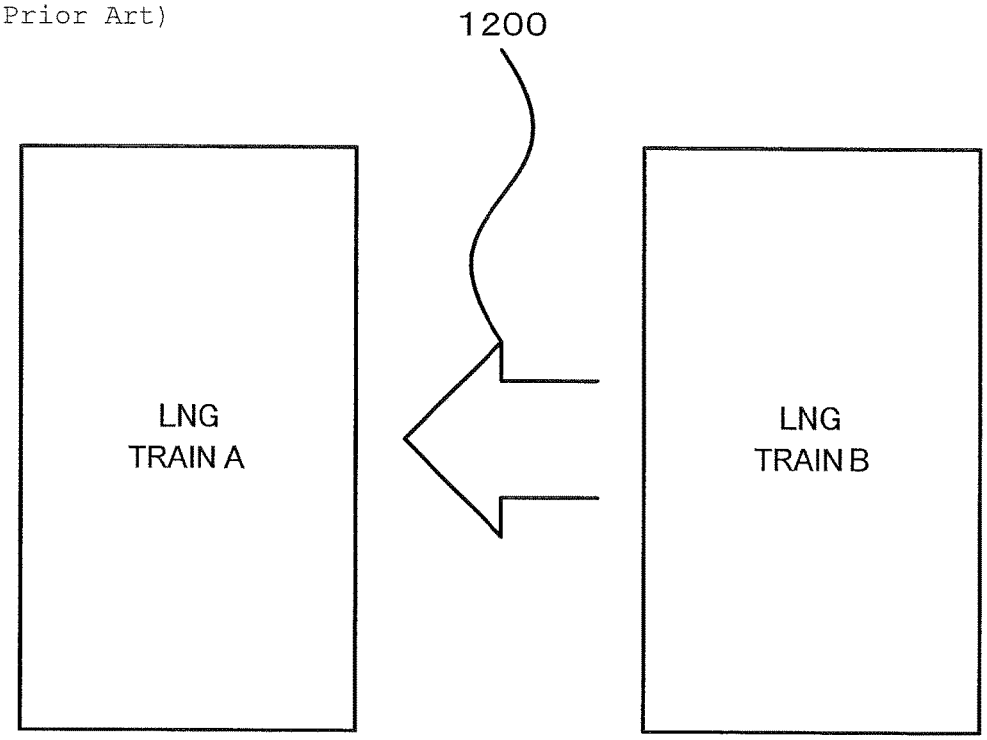
FIG.3 (Prior Art)
FIG. 3 is a plan view illustrating effects caused by hot air that flows between LNG production facilities.
Figure 4:
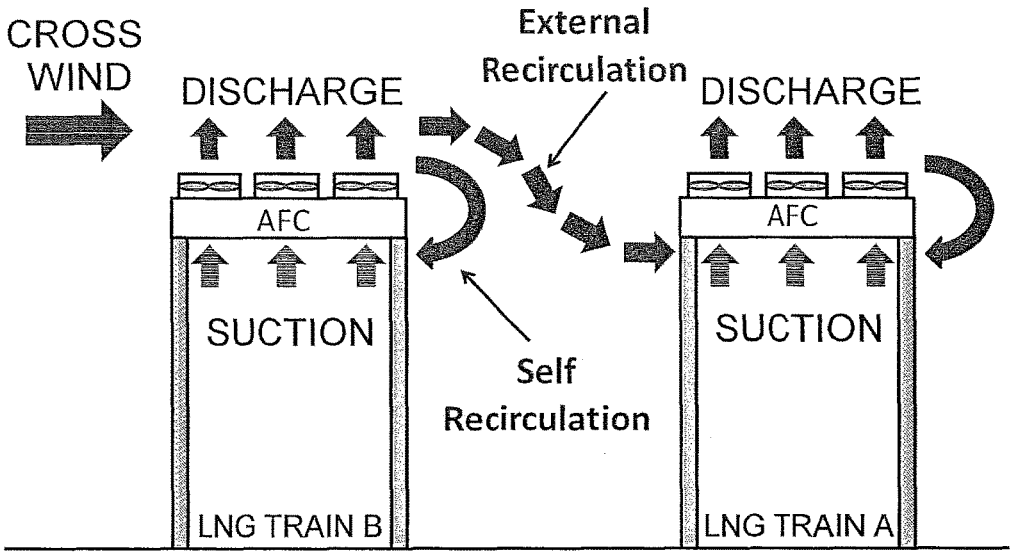
FIG. 4 (Prior Art)
FIG. 4 is a sectional view illustrating the effects caused by the hot air that flows between the LNG production facilities.
Figure 5:
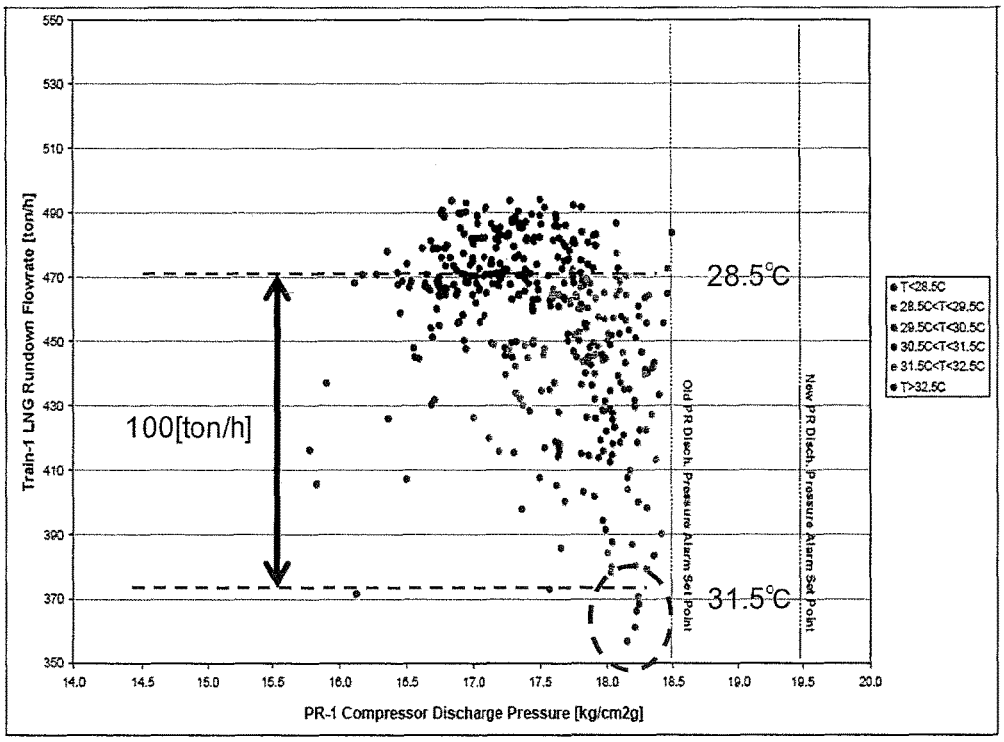
FIG. 5 (Prior Art)
FIG. 5 is a graph showing the relationship between the increase in the inlet temperature of air fin coolers and the amount of LNG production.
Figure 7:
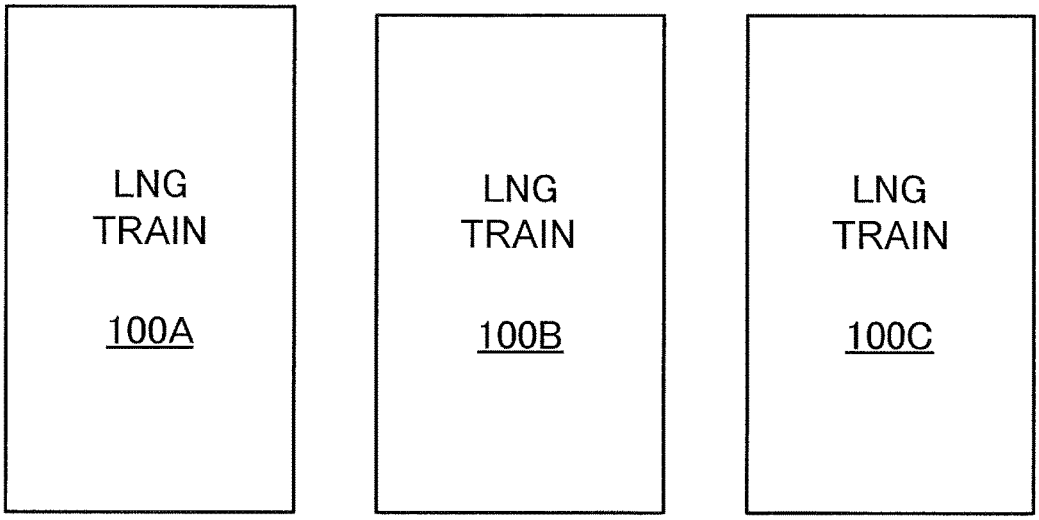
FIG. 7 illustrates an example of a parallel arrangement of conventional LNG production facilities.

FIG. 7 illustrates an example of a parallel arrangement of conventional LNG production facilities. In the conventional parallel arrangement, the amount of LNG production is reduced due to the "external HAR" as described above with reference to FIGS. 3 to 5.

Figure 8:
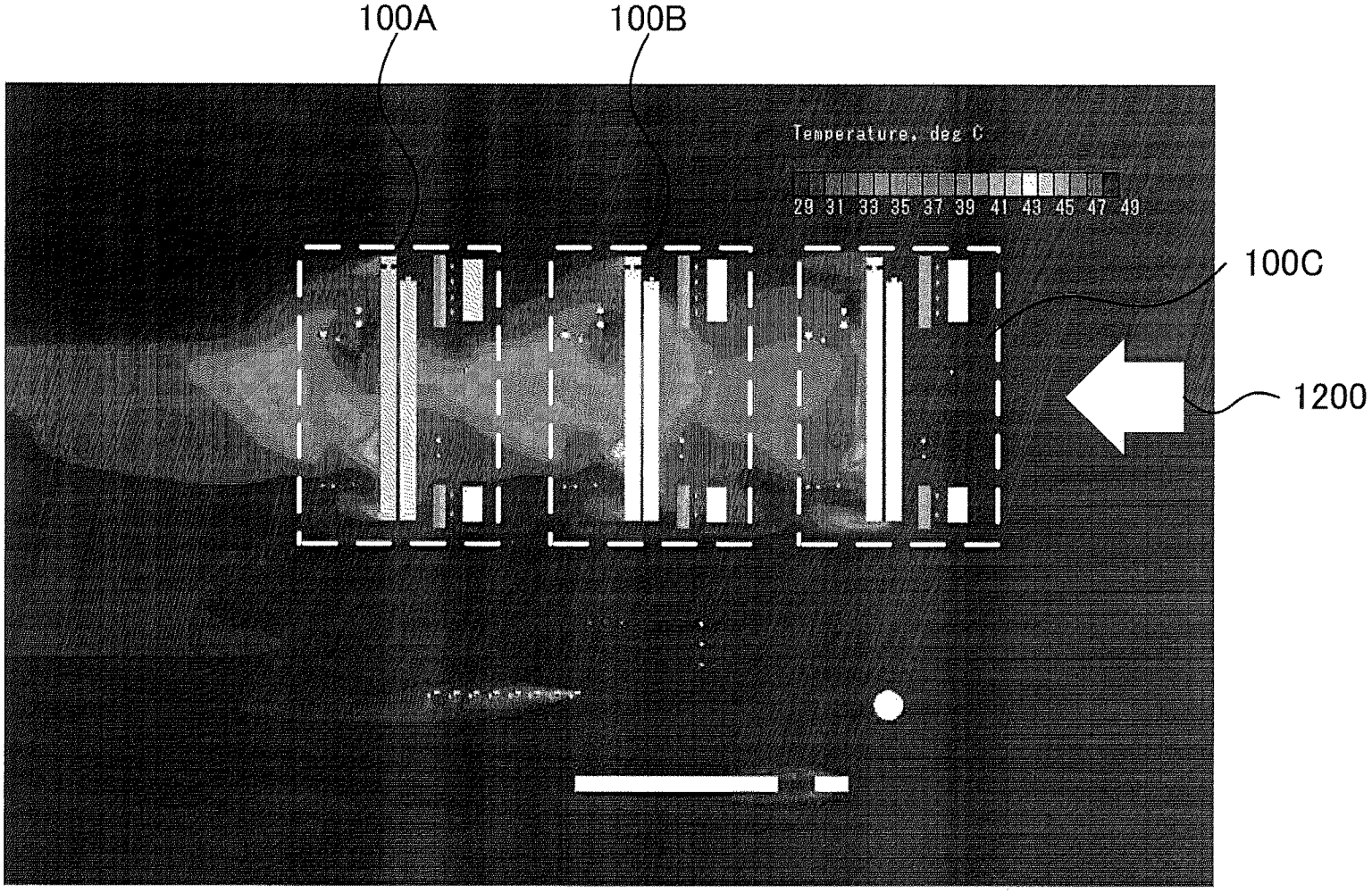
FIG. 8 illustrates a CFD analysis result of the parallel arrangement of the LNG production facilities.

FIG. 8 illustrates a CFD analysis result of an example of the parallel arrangement of the LNG production facilities. More specifically, FIG. 8 is the result of computational fluid dynamics (CFD) analysis, which is computational fluid analysis, obtained when trains having a length of 260 m in a longitudinal direction are in the conventional parallel arrangement. Details of the computational fluid analysis will be described below in [6] Computational Fluid Analysis.

As illustrated in FIG. 8, hot air, which is shown as whitish areas, remains in a space between LNG trains 100C and 1008. The "external HAR" occurs due to the hot air that remains in the space between the trains.

Figure 9:
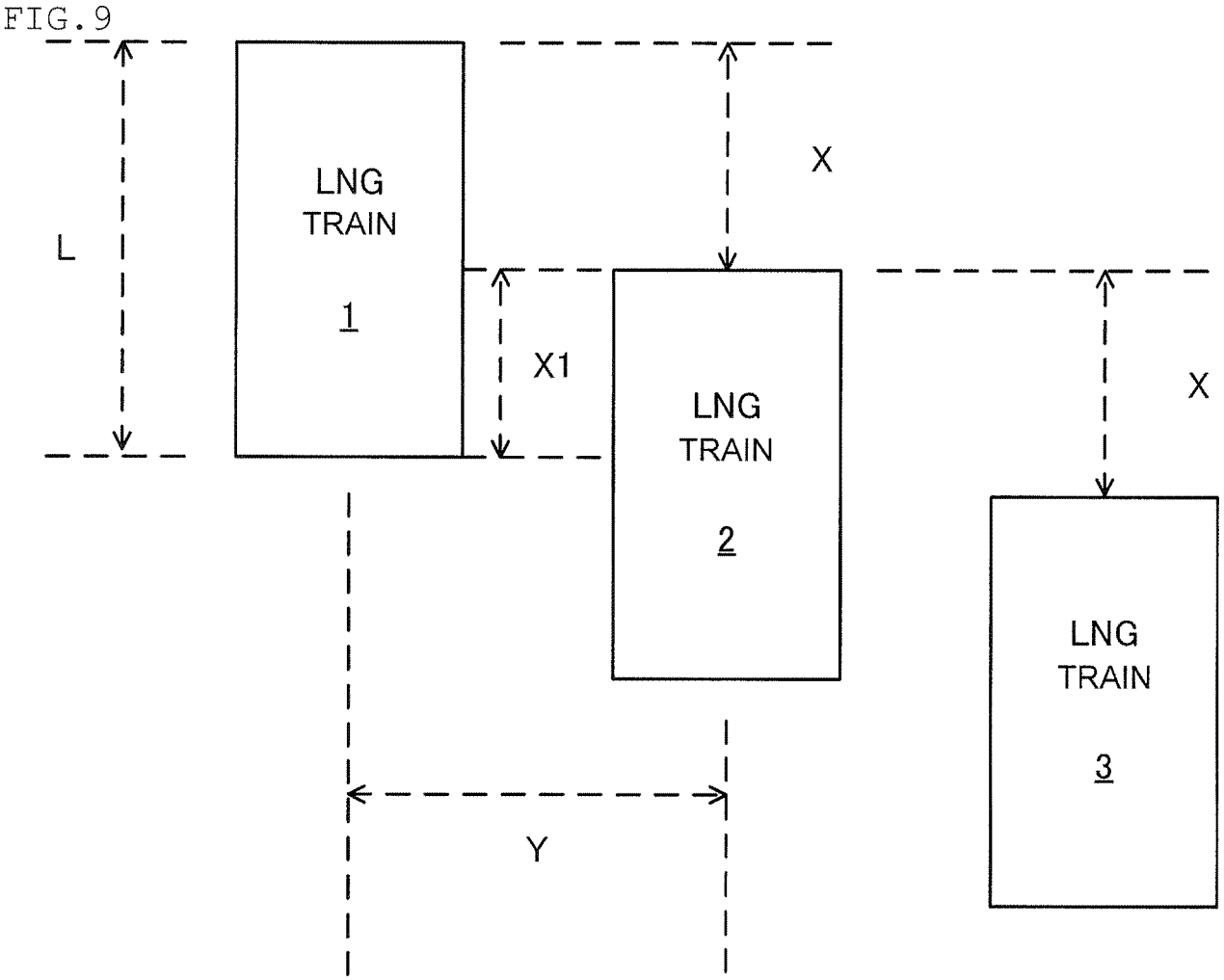
FIG. 9 illustrates an example of an arrangement of LNG production facilities according to an embodiment.

[3] LNG Production Facilities According to One or More Embodiments of the Invention FIG. 9 illustrates an example of an arrangement of LNG production facilities according to an embodiment of the invention. The dimension data of LNG trains 1 to 3 illustrated in FIG. 9 is as follows.

L [m]=260

X [m]>0

0≤X1 [m]<260

Y [m]=240

In the above expressions, L is the length of the LNG trains in the longitudinal direction, X is the distance by which the LNG trains are shifted in the longitudinal direction (hereinafter referred to also as "offset distance"), and Y is the distance between the trains. The wind direction "East" is the direction of east wind that blows from right to left in FIG. 9, and the wind direction "Center to Center" is the direction of wind that blows between the centers of the trains. In addition, X/L, which is the ratio of the amount of shift, is referred to as "offset ratio" in this specification, and X1 is a length over which the trains overlap each other in the longitudinal direction in the state in which the trains are shifted by X.

Table 1 shows components of each LNG train.

TABLE 1

| Components | |
|---|---|
| Lean Amine Cooler | 02X-E1003 |
| Amine Regen. OVHD Condenser | 02X-E1004 |
| Dryer Regen. Gas Cooler | 03X-E1002 |
| Demethanizer Bottom Cooler | 04X-E1006 |
| Depropanizer Condenser | 04X-E1008 |
| Debutanizer Condenser | 04X-E1010 |
| Debutanizer Bottom Cooler | 04X-E1011 |
| C3 Comp. Desuperheater | 05X-E1001 |
| C3 Condenser | 05X-E1002 |
| C3 Subcooler | 05X-E1003 |
| LP MR Comp Aftercooler | 05X-E1004 |
| MP MR Comp Aftercooler | 05X-E1005 |
| HP MR Comp Aftercooler | 05X-E1006 |
| End Flas Gas Comp. 1st Intercooler | 05X-E2001 |
| End Flas Gas Comp. 2nd Intercooler | 05X-E2002 |
| End Flas Gas Comp. 3rd Intercooler | 05X-E2003 |
| End Flas Gas Comp. Aftercooler | 05X-E2004 |

Figure 10A:
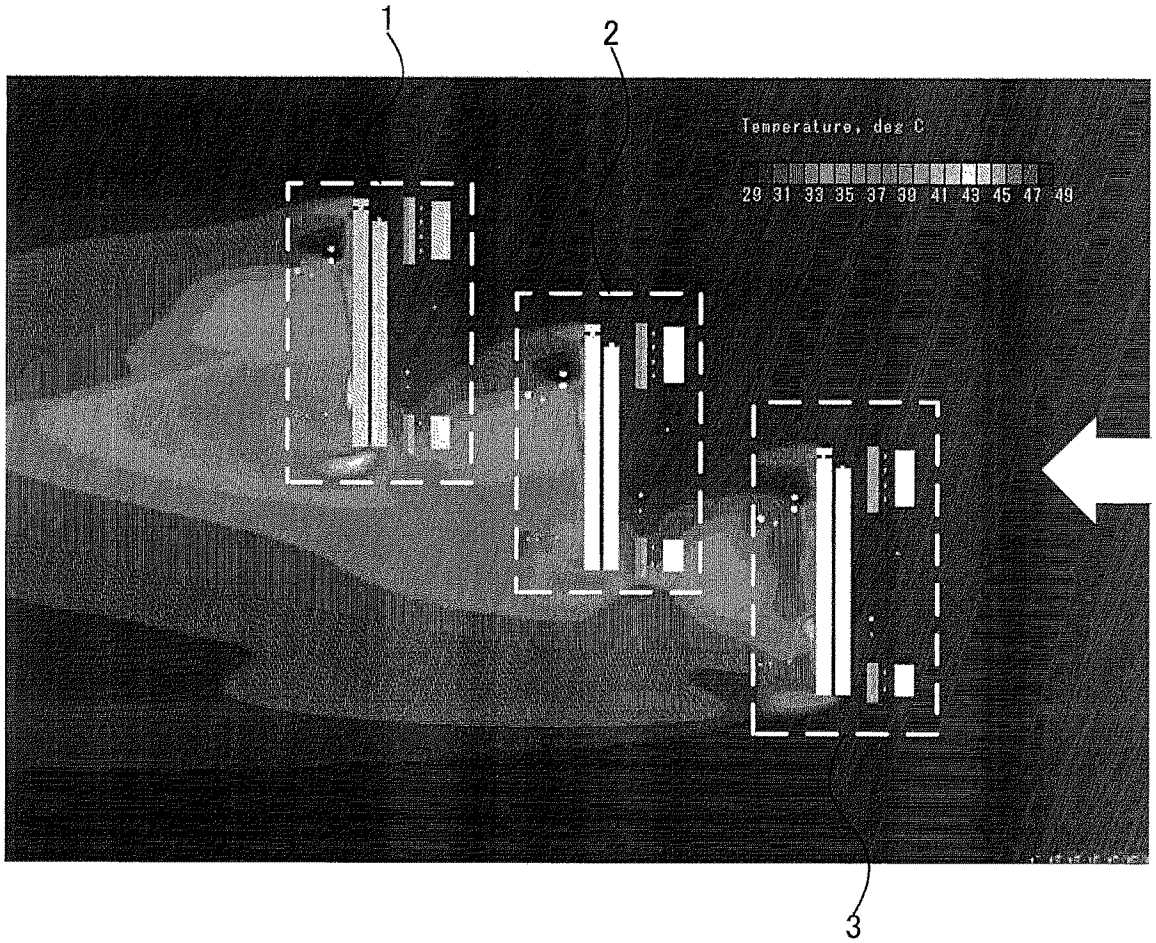
FIG. 10A illustrates an example of a CFD analysis result showing the influence of east wind.
Figure 10B:
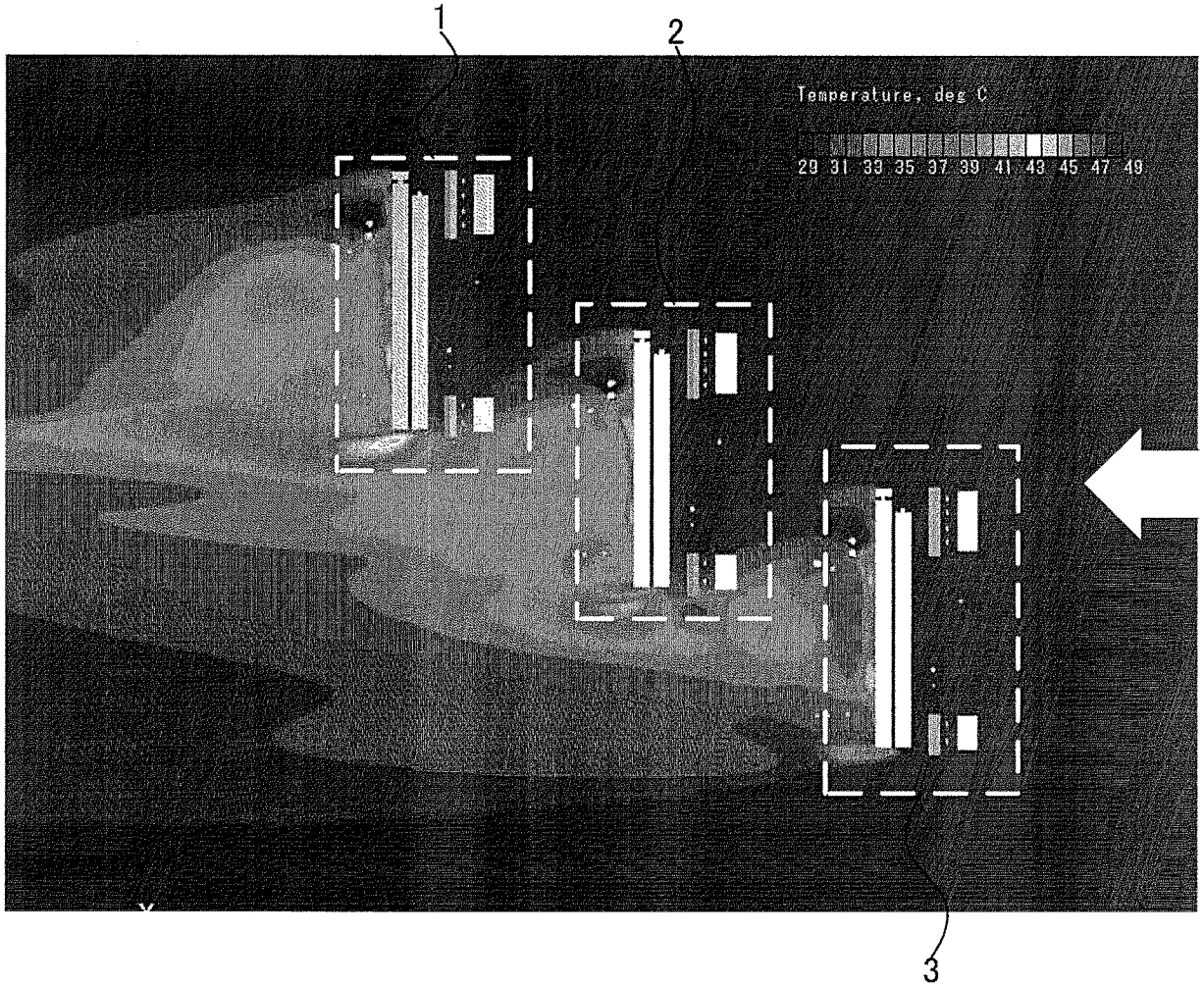
FIG. 10B illustrates an example of a CFD analysis result showing the influence of east wind.
Figure 10C:
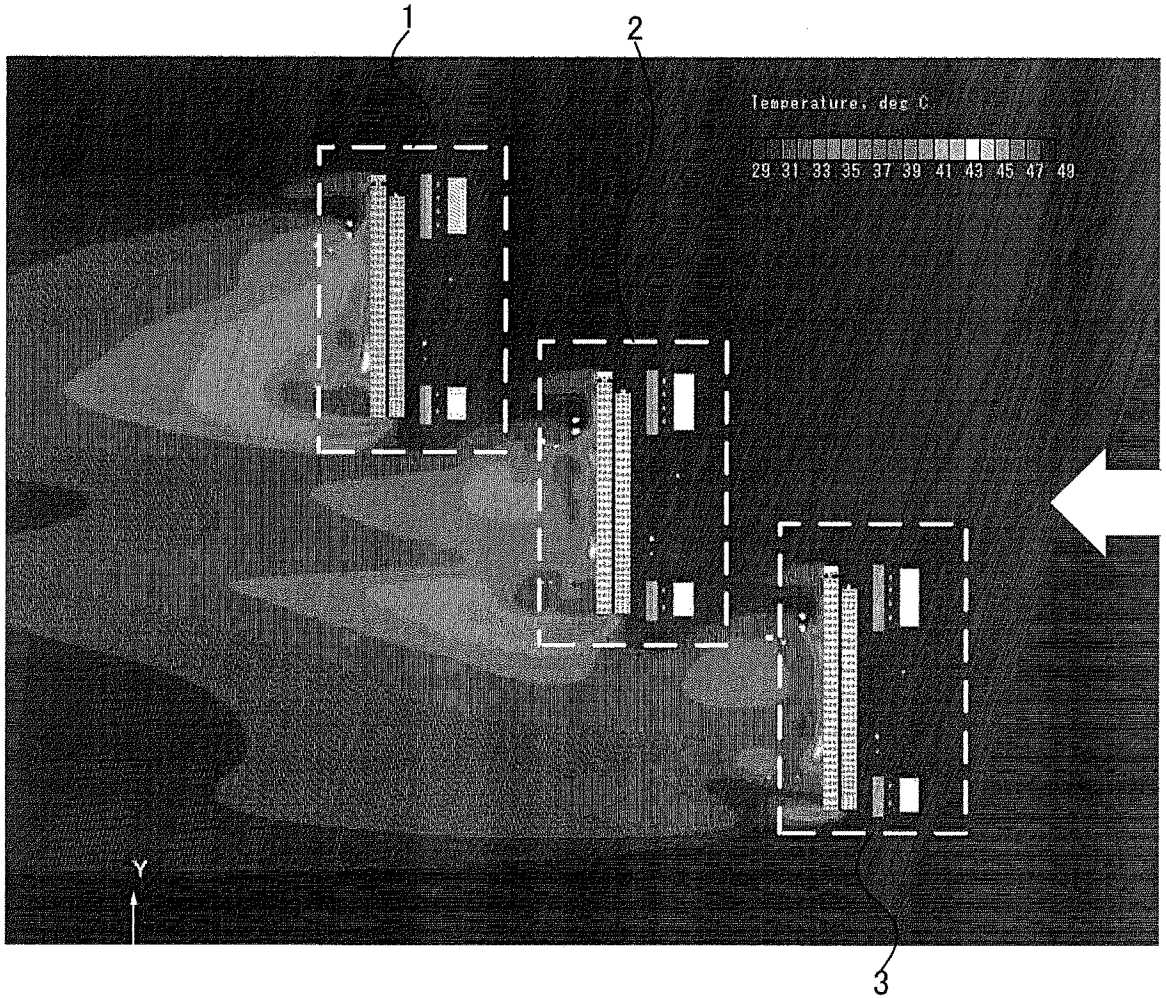

FIGS. 10A to 10C illustrate examples of CFD analysis results showing the influence of east wind (wind direction: "East").

FIG. 10A illustrates a CFD analysis result obtained when the offset distance X is "130 m" and the offset ratio X/L is "0.50". FIG. 10B illustrates a CFD analysis result obtained when the offset distance X is "160 m" and the offset ratio X/L is "0.61". FIG. 100 illustrates a CFD analysis result obtained when the offset distance X is "210 m" and the offset ratio X/L is "0.81".

As is clear from FIGS. 10A to 10C, the amount of hot air that remains in the spaces between the trains is reduced. This means that, by shifting the LNG trains 3 and 2 from each other by the offset distance X in the longitudinal direction, the hot air can easily leave the space between these trains, and the temperature increase at the inlet of the air fin cooler of the LNG train 2 due to the external HAR can be suppressed. Similarly, by shifting the LNG trains 2 and 1 from each other by the offset distance X in the longitudinal direction, the hot air can easily leave the space between these trains, and the temperature increase at the inlet of the air fin cooler of the LNG train 1 due to the external HAR can be suppressed.

Figure 11A:
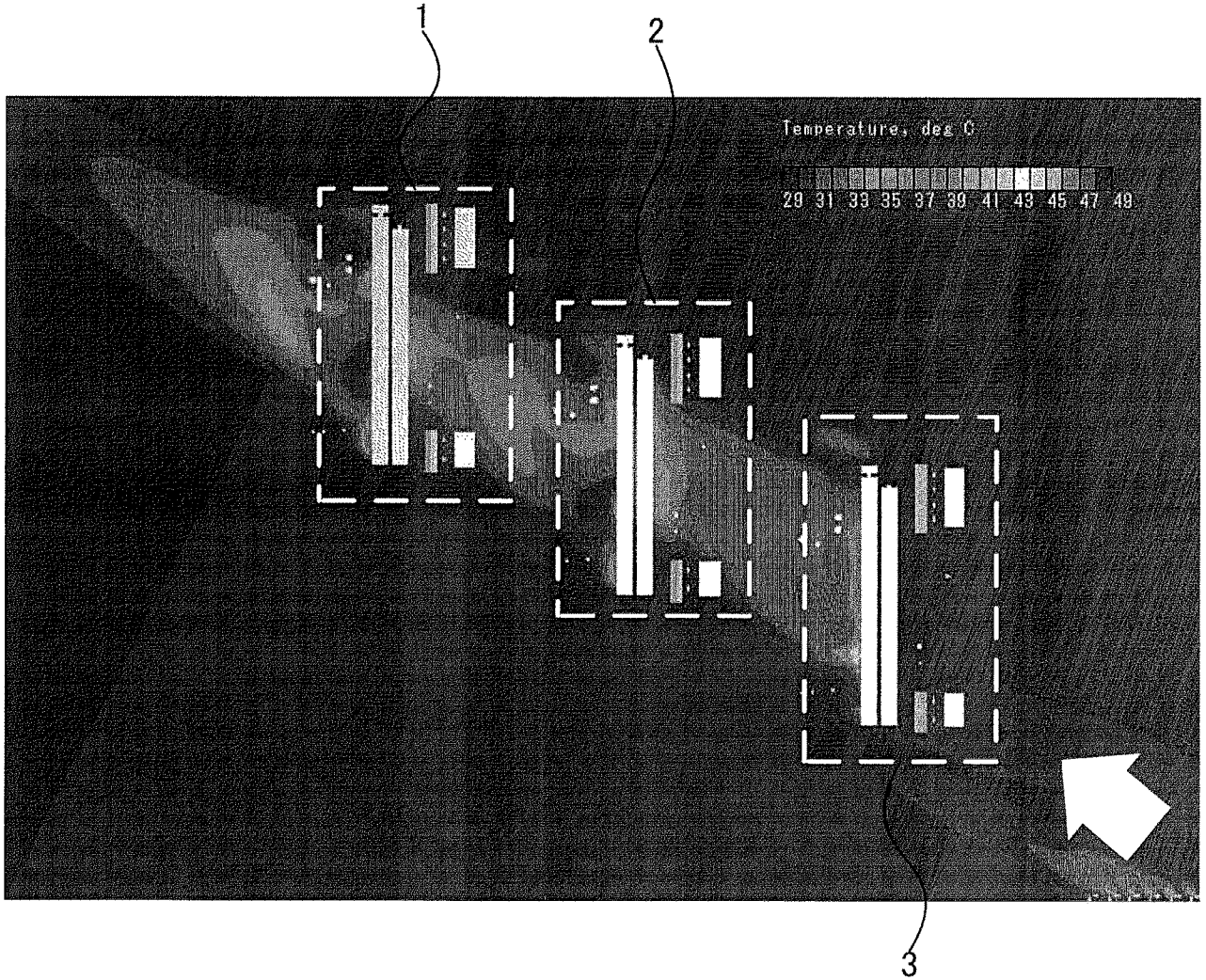
FIG. 11A illustrates an example of a CFD analysis result showing the influence of wind that blows between train centers.
Figure 11B:
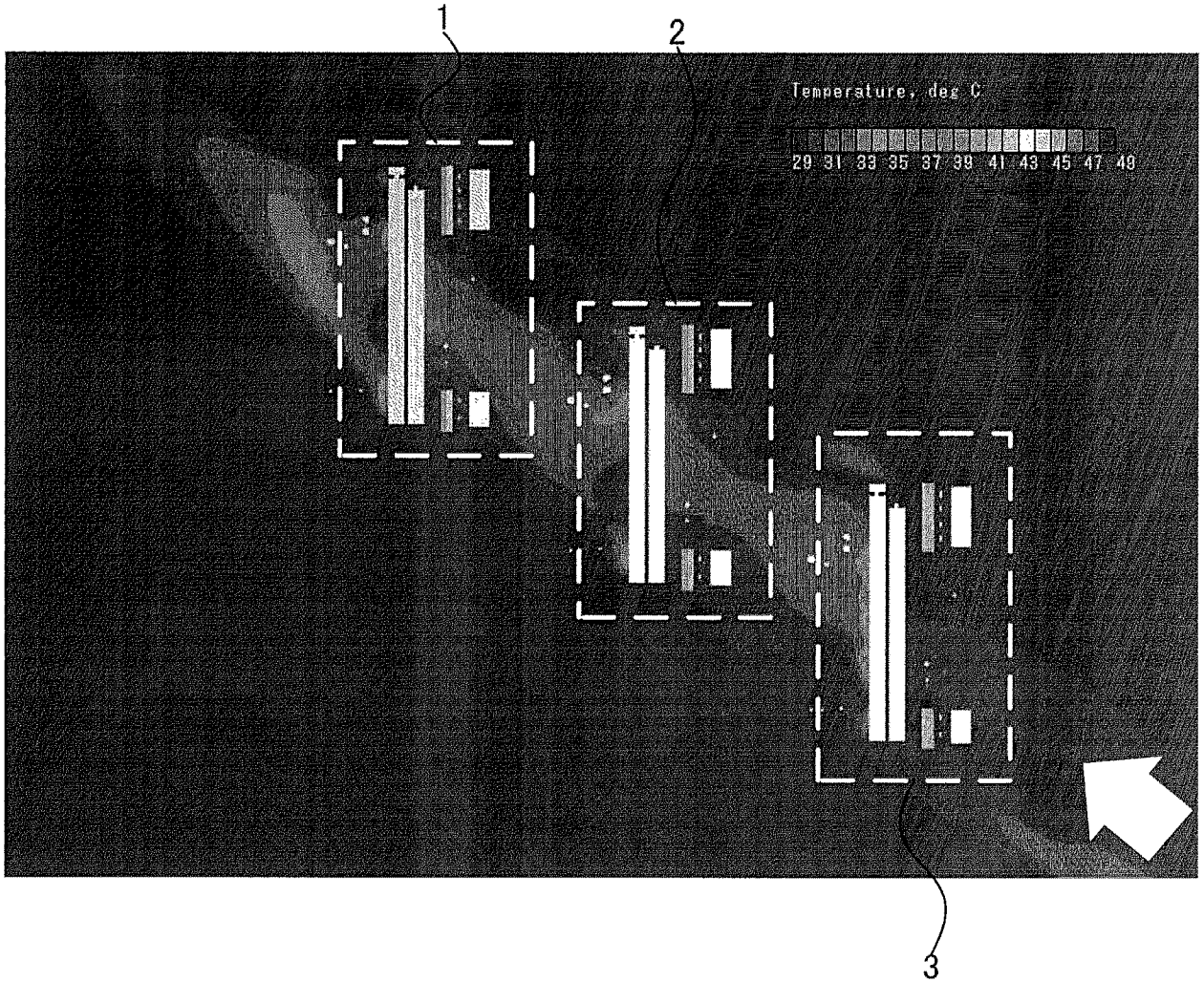
FIG. 11B illustrates an example of a CFD analysis result showing the influence of wind that blows between the train centers.
Figure 11C:
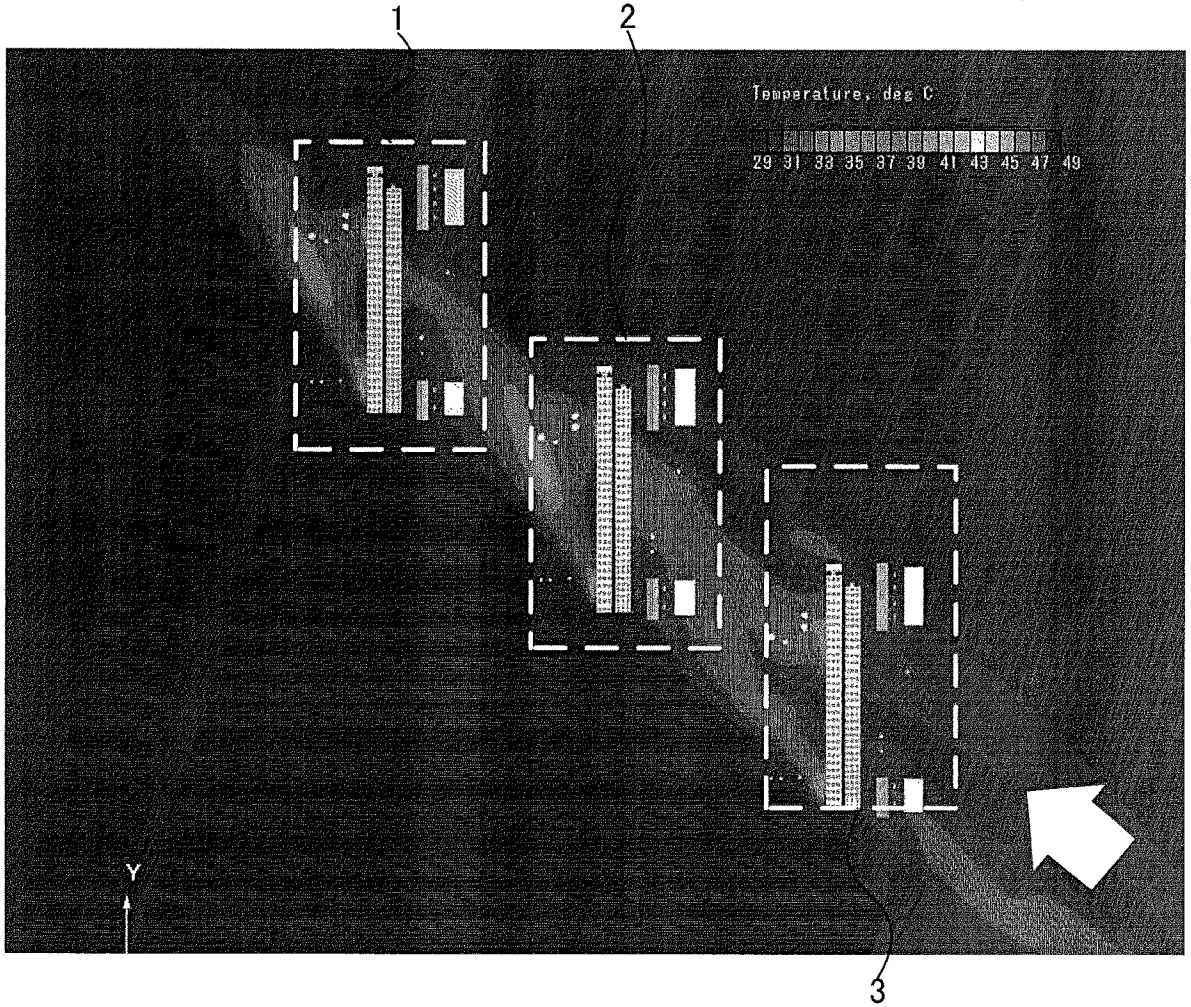
FIG. 11C illustrates an example of a CFD analysis result showing the influence of wind that blows between the train centers.

FIGS. 11A to 11C illustrate examples of CFD analysis results showing the influence of wind that blows between the centers of the trains (wind direction: "Center to Center").

FIG. 11A illustrates a CFD analysis result obtained when the offset distance X is "130 m" and the offset ratio X/L is "0.50". FIG. 11B illustrates a CFD analysis result obtained when the offset distance X is "160 m" and the offset ratio X/L is "0.61". FIG. 11C illustrates a CFD analysis result obtained when the offset distance X is "210 m" and the offset ratio X/L is"0.81".

The CFD analysis is performed by setting the wind direction to such a direction that hot air easily remains in the spaces between the trains that are shifted from each other in the longitudinal direction. Also in this case, hot air does not easily remain since the distances between the centers of the trains are greater than those in the parallel arrangement illustrated in FIG. 8.

[4] Temperature Increase in LNG Production Facilities According to One or More Embodiments of the Invention Next, temperature change that occurs in each of the LNG trains 1 to 3 when the offset ratio "X/L" is changed will be described.

Figure 12:
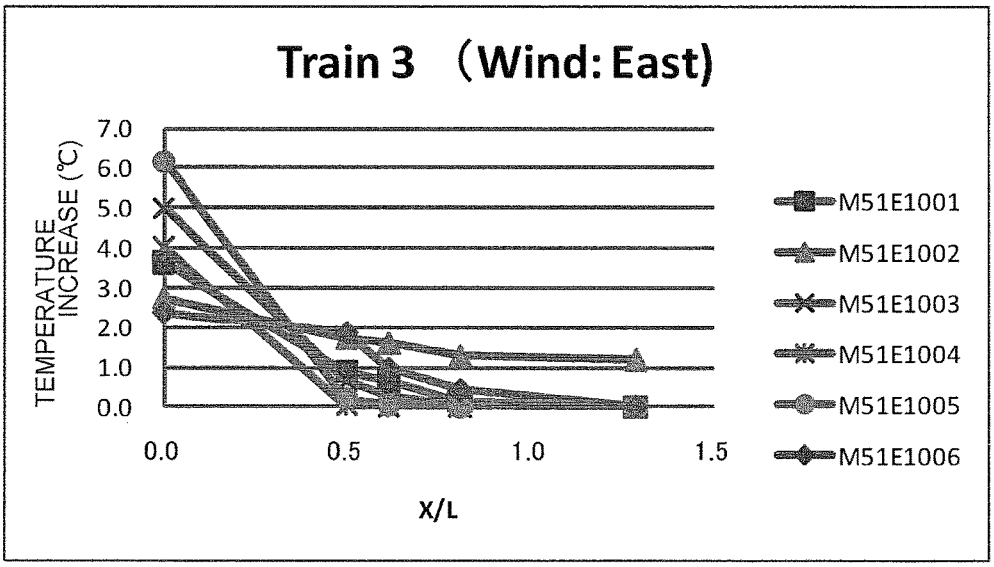
FIG. 12 is a graph showing the temperature change in an LNG train 3 illustrated in FIG. 9.
Figure 12:
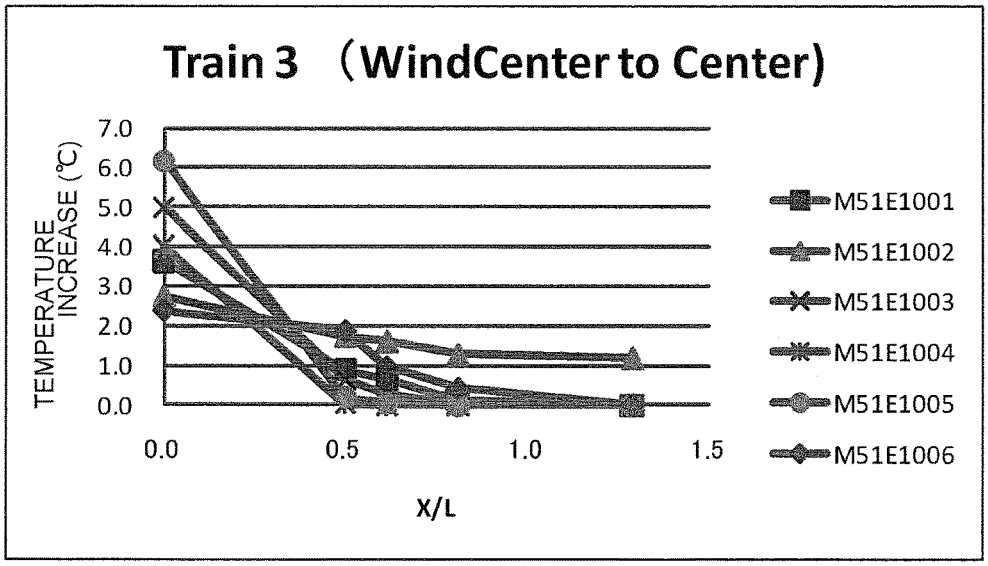
Figure 13:
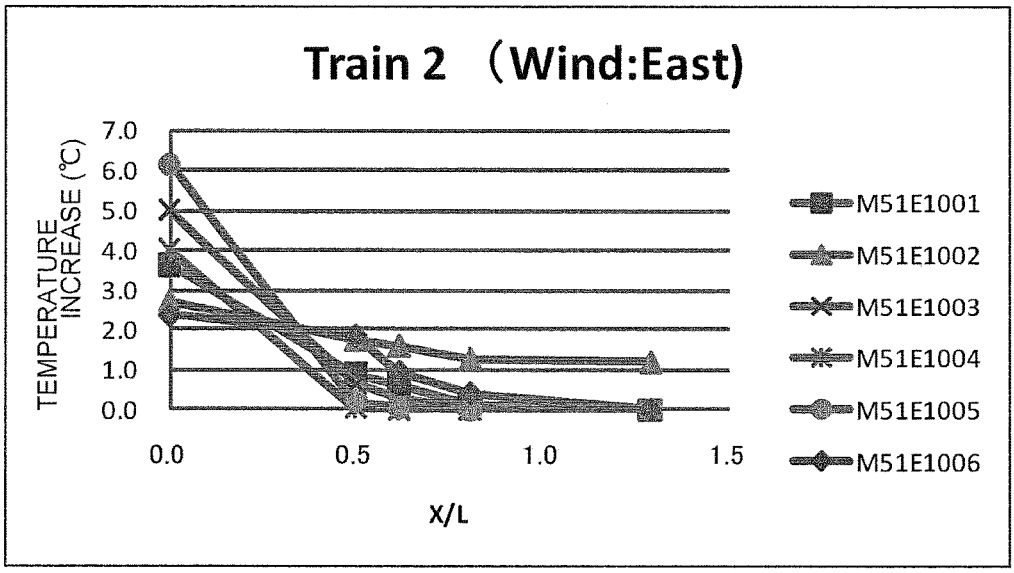
FIG. 13 is a graph showing the temperature change in an LNG train 2 illustrated in FIG. 9.
Figure 13:
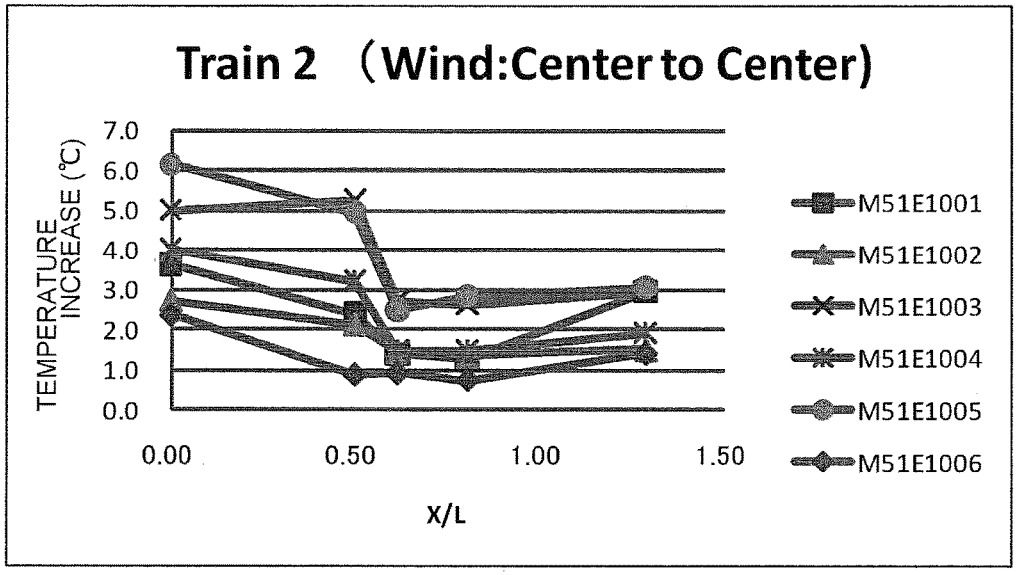
Figure 14:
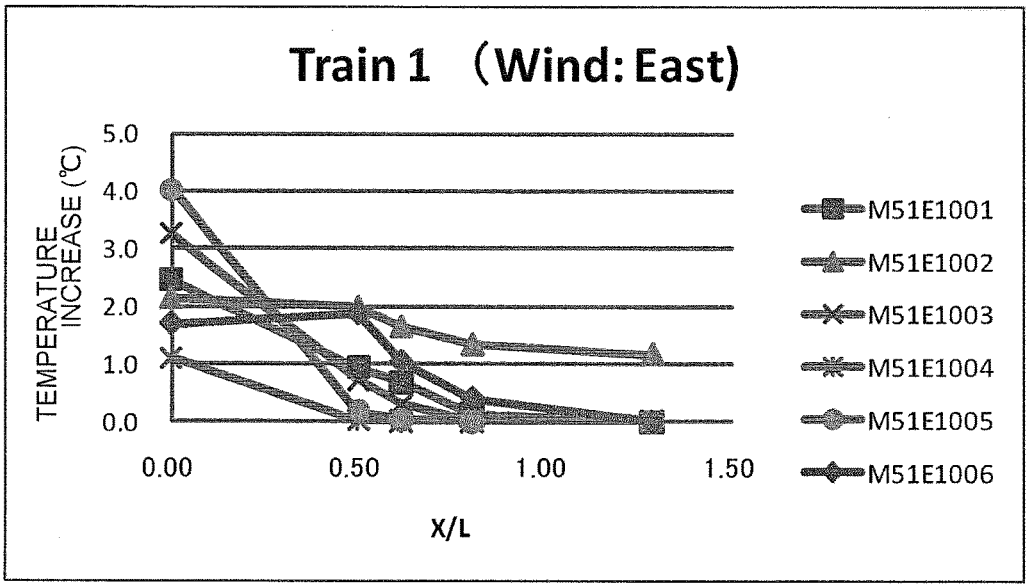
FIG. 14 is a graph showing the temperature change in an LNG train 1 illustrated in FIG. 9.
Figure 14:
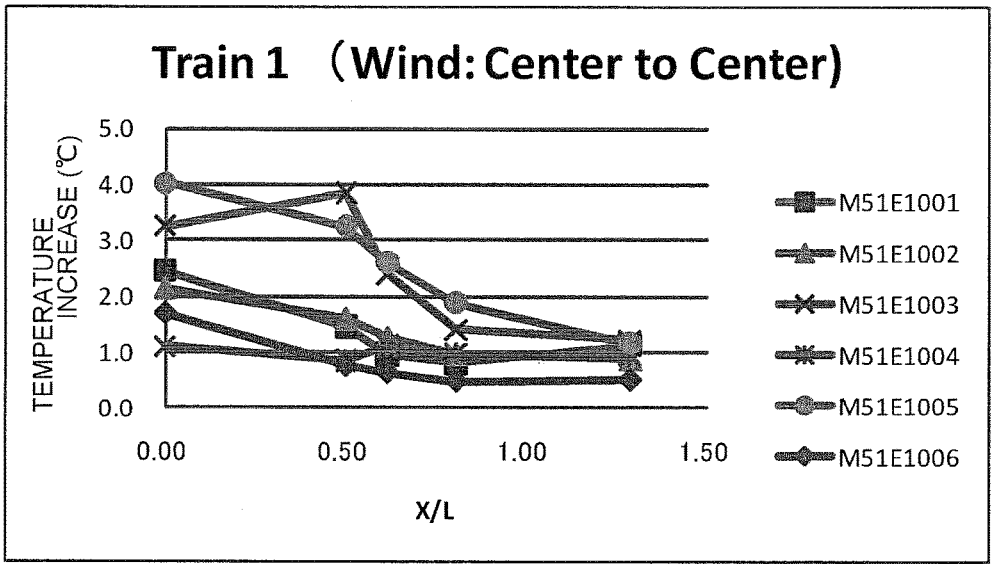

FIGS. 12 to 14 are graphs showing the CFD analysis results regarding the temperature increase in air fin coolers included in the LNG trains in the case where east wind (wind direction: "East") or wind that blows between the centers of the trains (wind direction: "Center to Center") is applied. The vertical axis "temperature increase" in each graph represents the temperature increase from the temperature at the time when there is no wind. In each graph, M51E1001 to M51E1006 represent the air fin coolers, and correspond to 05X-E1001 to 05X-E1006 in Table 1.

FIG. 12 is a graph showing the temperature change in the LNG train 3 illustrated in FIG. 9. As is clear from FIG. 12, the influence of hot air that remains in the spaces between the trains decreases as the offset ratio increases.

FIG. 13 is a graph showing the temperature change in the LNG train 2 illustrated in FIG. 9. As is clear from FIG. 13, the influence of hot air that remains in the spaces between the trains decreases as the offset ratio increases. In particular, when the offset ratio is higher than 0.6, the temperature increase is reduced by a large amount.

FIG. 14 is a graph showing the temperature change in the LNG train 1 illustrated in FIG. 9. As is clear from FIG. 14, the influence of hot air that remains in the spaces between the trains decreases as the offset ratio increases. In particular, when the offset ratio is higher than 0.6, the temperature increase is reduced by a large amount.

Figure 15:
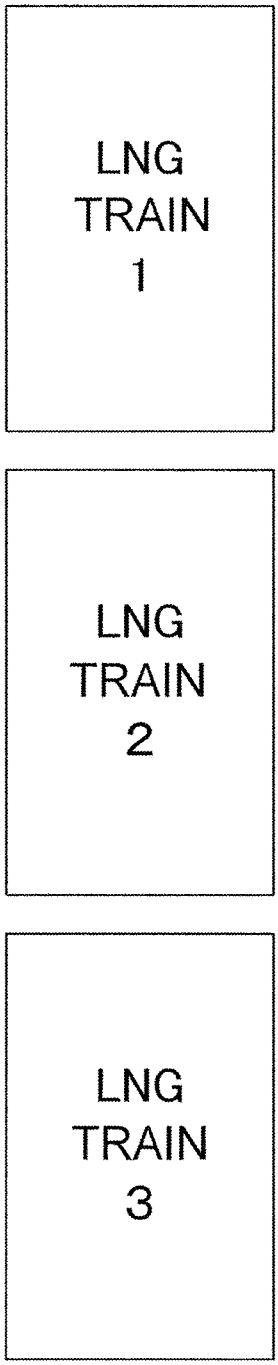
FIG. 15 illustrates an example of an arrangement of LNG production facilities in the case where an offset ratio is "1".

FIG. 15 illustrates an example of an arrangement of the LNG production facilities in which the offset ratio is "1". FIGS. 12 to 14 show the cases where the offset ratio is 1 or more. It is clear from FIGS. 12 to 14 that when the offset ratio is 1 or more, the influence of the external HAR can be substantially eliminated. In the case where the offset ratio is 1 or more, similar to the layout illustrated in FIG. 15, the LNG trains may be arranged along the same straight line in the longitudinal direction of the LNG trains, and the distance between the trains (distance Y in FIG. 9) may be set to zero.

When the LNG trains are shifted from each other in the longitudinal direction, the total area required to place the LNG production facilities increases, and the lengths of pipes that connect the LNG trains and utility facilities also increase. Therefore, there is a possibility that the cost will be increased compared to the conventional case where the plot area is minimized. In the example illustrated in FIG. 15, since the distance between the trains (distance Yin FIG. 9) is reduced to zero, the dead zone can be reduced. As a result, the increase in cost can be reduced.

Figure 16:
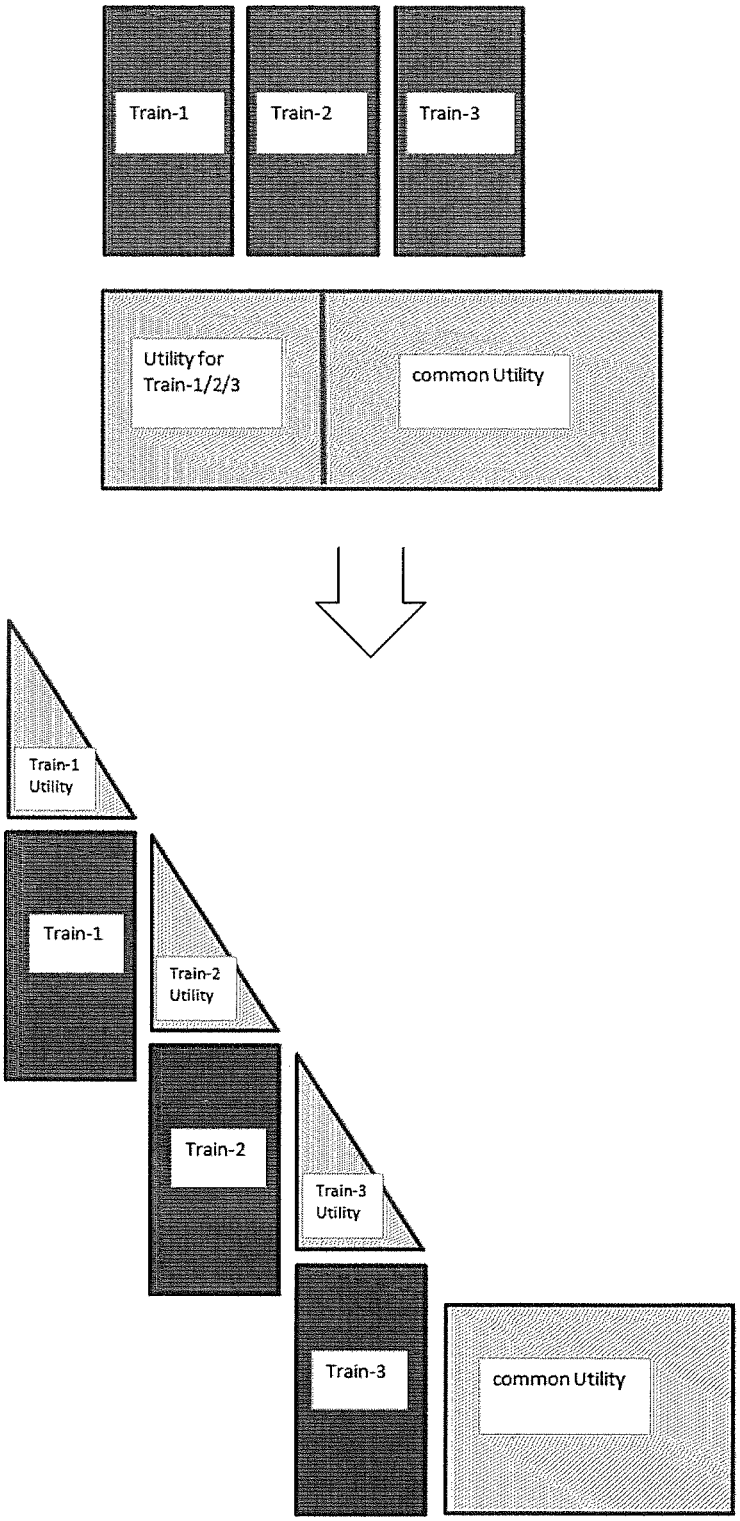
FIG. 16 illustrates LNG production facilities in which a utility facility is arranged for each train.

FIG. 16 illustrates LNG production facilities in which a utility facility is arranged for each train. As shown in the lower part of FIG. 16, the utility facilities for the respective trains (Utility for Train-1/2/3) other than a common utility facility (Common Utility) shared by all of the trains are separately arranged for the respective trains that are shifted from each other in the longitudinal direction. Thus, the increase in cost can be minimized.

FIGS. 12 to 14 show the temperature of each of the air fin coolers listed in Table 1determined by the CFD analysis. As is clear from the CFD analysis results shown in FIGS. 10 and 11, air fin coolers disposed at a downstream side in the direction in which the LNG trains are shifted along the longitudinal direction (direction from top to bottom in the figures) are influenced by the residual hot air. Therefore, it is important that air fin coolers, such as a propane (C3) subcooler (05X-E1003), that greatly affect the amount of LNG production unless they are sufficiently cooled are riot disposed in a central region in the longitudinal direction of each train but are disposed at an upper side (in a direction opposite to the direction in which the LNG trains are shifted (direction from bottom to top in the figures)) of the train.

When the LNG trains are shifted in the longitudinal direction as described above, the influence of the external HAR can be reduced and the amount of LNG production can be increased. In addition, the air fin coolers can optimally arranged so as to prevent the accumulation of hot air.

[5] Weather Analysis Models

An example in which a weather predicting apparatus performs the above-described computational fluid analysis by using output data of weather analysis models mentioned below will now be described.

When measuring the temperature and wind direction in an area in which a liquefied gas production facility is to be located, it is necessary to carry out the measurement of the temperature and wind direction over multiple years since the liquefied gas production facility needs to be designed in consideration of the influence of annual changes, such as whether or not the El Nino phenomenon is observed. However, if data of multiple years is not available, it is difficult to carry out the measurement of the temperature and wind direction that takes multiple years. Therefore, the liquefied gas production facility needs to be designed on the basis of low-precision environmental data.

Japanese Unexamined Patent Application Publication No. 2009-62983 discloses a method of estimating an amount of gas emitted from a gas turbine. Since the amount of gas emitted from the gas turbine is a function of weather conditions (temperature, atmospheric pressure, and humidity) at the site, the estimation is performed by generating an emission amount output report including emission levels on the basis of a plurality of items of weather data. This method is used to prevent lean blowout of a combustion system in an operation of reducing the amount of emission of NOx by taking countermeasures in advance by utilizing the weather information. Japanese Unexamined Patent Application Publication No. 2010-60443 discloses a weather forecast based on weather simulations, and Japanese Unexamined Patent Application Publication No. 2005-283202 discloses a technology concerning a prediction of diffusion of radioactive materials and the like. The purpose of these technologies is to predict future weather conditions, such as to forecast the weather or to predict the diffusion of dangerous materials, and no technology for predicting weather on the basis of weather simulations in order to design a liquefied gas production facility is disclosed.

Weather analysis models include various physical models, and weather simulations can be carried out by performing weather prediction calculations with high spatial resolution by analyzing the physical models with a computer. Weather simulations have an advantage over field observation in that weather information can be estimated with high spatial resolution.

To carry out weather simulations, it is necessary to obtain initial values and boundary value data from a weather database downloaded from a network. To design an LNG production facility, although the spatial resolution is not sufficiently high, National Centers for Environmental Prediction (NCEP) data, which is global observation analysis data provided by, for example, National Oceanic and Atmospheric Administration (NOAA) and reanalyzed every six hours, may be used as weather information concerning a wide area including an area in which the LNG production facility is to be located (hereinafter referred to as "wide-area weather information"). The NCEP data as the wide-area weather information includes weather elements (wind direction, wind speed, turbulence energy, solar radiation, atmospheric pressure, precipitation, humidity, and temperature) on three-dimensional grid points obtained when the world is divided into grid cells (grid spacing is 1.5 to 400 km), and are updated every six hours. In the present embodiment, the LNG production facility needs to be designed in consideration of the influence of annual changes, such as whether or not the El Nino phenomenon is observed. Accordingly, wide-area weather information (for example, the above-described NCEP data) of multiple years is used as the initial values and boundary value data.

For example, the physical models included in the weather analysis models includes Weather Research & Forecasting (WRF) model. The WRF model includes various physical models, such as radiation models for calculating the amounts of solar radiation and atmospheric radiation, turbulence models for expressing turbulent mixing layers, and ground surface models for calculating the ground surface temperature, soil temperature, amount of soil moisture, amount of snowfall, surface flux, etc.

The weather analysis models include partial differential equations expressing the motion of fluid in the atmosphere, such as the Navier-Stokes equations concerning the motion of fluid and empirical equations derived from atmospheric observation results, and partial differential equations expressing the law of conservation of mass and energy. Weather simulations can be carried out by forming simultaneous equations of these differential equations and solving the simultaneous equations. Thus, the differential equations based on the weather analysis models for conducting the weather simulations are solved with the use of the wide-area weather information as the input data of initial values and boundary values, so that weather information of the location of the LNG production facility, which is related to an area having a narrower spatial resolution than that of the wide-area weather information, can be generated. The thus-generated weather information is referred to as "narrow-area weather information".

[6] Computational Fluid Analysis

Computational fluid analysis is a numerical analysis and simulation technique in which equations concerning the motion of fluid are solved by a computer and flow is observed by applying computational fluid dynamics. More specifically, by using the Navier-Stokes equations, which are fluid dynamics equations, the state of fluid is spatially calculated by the finite volume method. The procedure for the computational fluid analysis includes a step of creating 3D model data reflecting the structure of a facility to be examined, a step of creating a grid for dividing an area to be examined into grid cells that serve as smallest calculation units, a step of causing the computer to receive initial values and boundary values and solve the fluid dynamics equations for each grid cell, and a step of outputting various values (flow velocity, pressure, etc.) obtained from the analysis results as images for, for example, contour display and vector display.

With the computational fluid analysis, fluid simulations can be performed with a resolution higher than that of the weather analysis models. Therefore, it is possible to provide information concerning airflow phenomena unique to the space scale, such as small changes in the wind speed and wind direction, airflow turbulence on the scale of several centimeters to several meters, and changes in the airflow around a building, which are very difficult to obtain by the weather simulations.

[7] Functional Configuration and Hardware Configuration of Weather Predicting Apparatus The weather predicting apparatus calculates, based on the weather analysis models and computational fluid analysis, the narrow-area weather information of a narrow area in which the LNG production facility is to be located.

Figure 17A:
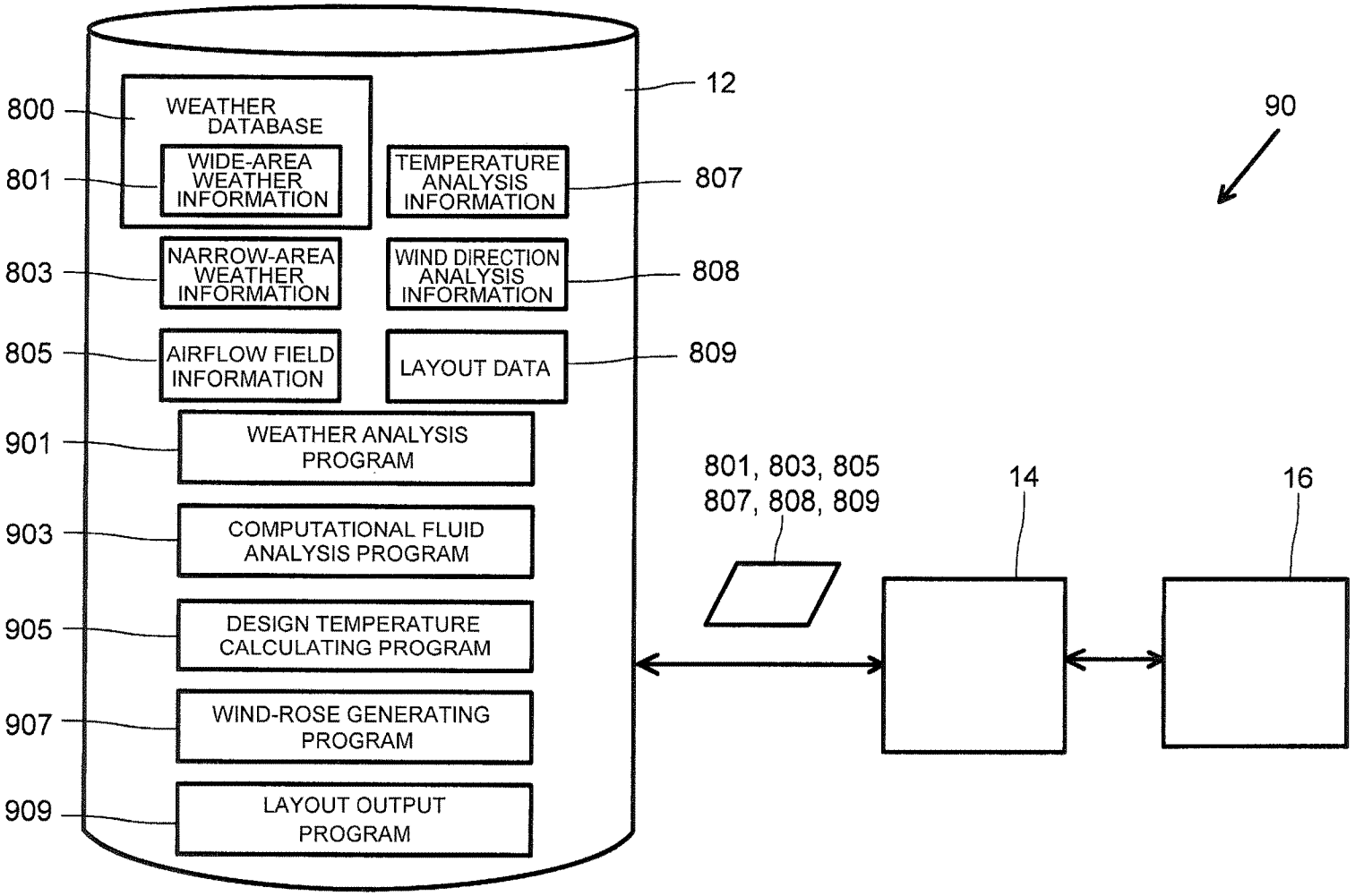
FIG. 17A illustrates an example of a functional configuration of a weather predicting apparatus.

FIG. 17A illustrates an example of the functional configuration of a weather predicting apparatus. A weather predicting apparatus 90 illustrated in FIG. 17A includes a storage section 12 that stores data and programs and a processing section (or "processor") 14 that executes arithmetic operations. The storage section 12 stores a weather analysis program 901, such as the WRF model, a computational fluid analysis program 903, a design temperature calculating program 905, a wind-rose generating program 907, a layout output program 909 that generates a layout, a weather database 800, wide-area weather information 801, such as NCEP data, narrow-area weather information 803 obtained by the weather simulations, airflow field information 805 obtained by the computational fluid analysis, temperature analysis data 807, wind direction analysis data 808, and layout data 809. The weather database stores the wide-area weather data 801, and is downloaded from an external source or received from a storage medium.

The processing section 14 executes the weather analysis program 901 to perform a weather analysis process in which the narrow-area weather information 803 is generated from the wide-area weather information 801 and stored in the storage section 12. In addition, the processing section 14 executes the computational fluid analysis program 903 to perform a computational fluid process in which the airflow field data 807 is generated from the narrow-area weather information 803 and stored in the storage section 12.

In addition, the processing section 14 executes the layout generating program 909 and outputs the layout data 809 based on the wind direction analysis data 808.

FIG. 17B illustrates an example of a weather information data table. Although the data table illustrated in FIG. 17B shows the wide-area weather information 801, the data table is also applicable to the narrow-area weather information 803. The wide-area weather information is weather information of an area that includes a narrow area corresponding to the narrow-area weather information and that is wider than the narrow area. As illustrated in FIG. 17B, the weather information is presented as a plurality of record sets including various data such as time, which serves the primary key, wind direction, wind speed, turbulence energy, solar radiation, atmospheric pressure, precipitation, humidity, and temperature. In other words, the weather information is presented as weather information sets classified based on the temperature. The wide-area weather information 801 and the narrow-area weather information 803 are weather information sets classified based on the area.

Figure 18:
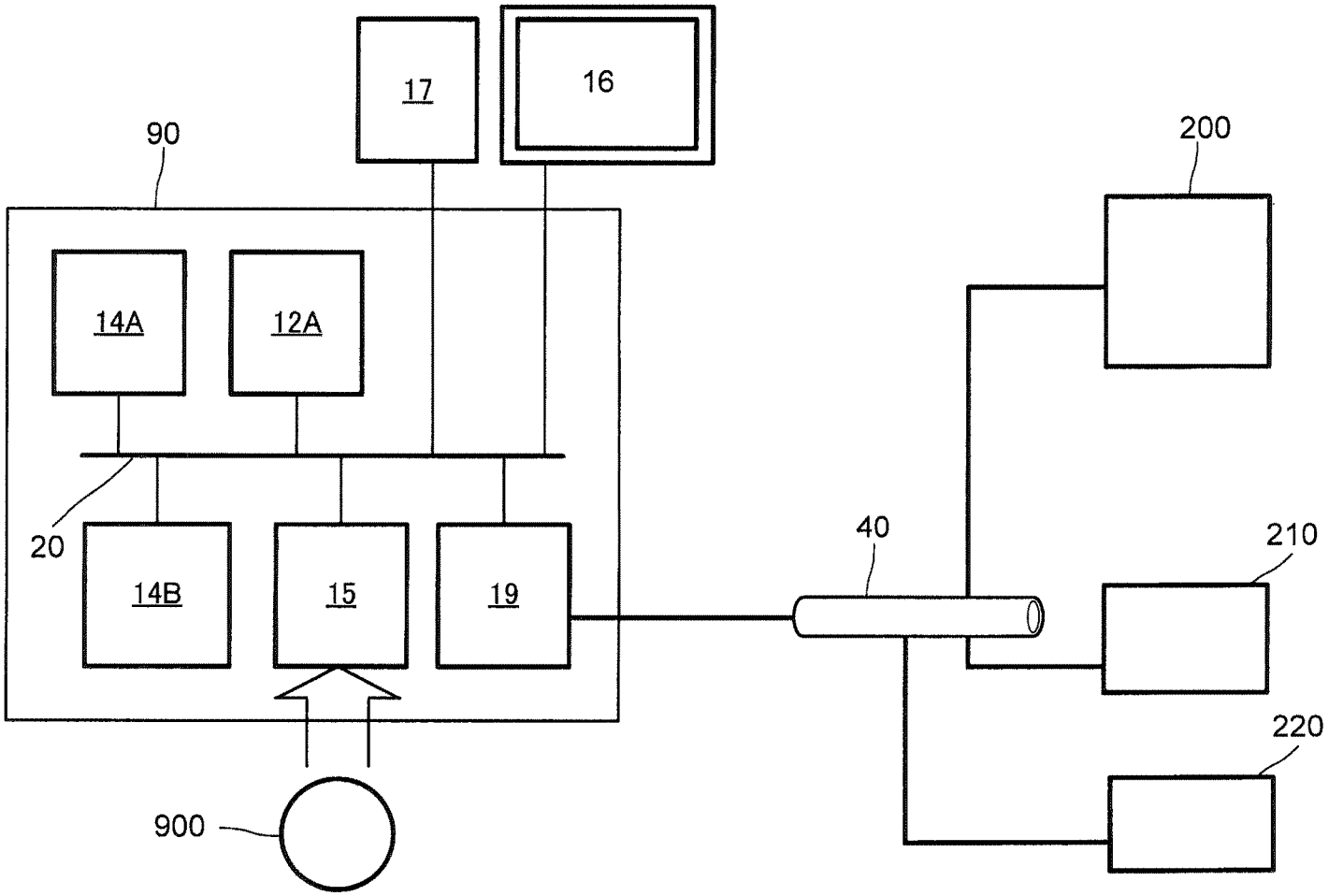
FIG. 18 illustrates an example of a hardware configuration of the weather predicting apparatus.

FIG. 18 illustrates an example of the hardware configuration of the weather predicting apparatus. The weather predicting apparatus 90 illustrated in FIG. 18 includes a processor 12A, a main storage device 14A, an auxiliary storage device 14B, such as a hard disk or a solid state drive (SSD), a drive device 15 that reads data from a storage medium 900, and a communication device 19, such as a network interface card (NIC). These components are connected to one another by a bus 20. The weather predicting apparatus 90 is connected to a display 16, which is an external device that serves as an output device, and an input device 17, such as a keyboard and a mouse. The processing section 14 illustrated in FIG. 17A corresponds to the processor 12A, and the storage section 12 corresponds to the main storage device 14A.

The storage medium 900 may store, as data, the weather database 800, the weather analysis program 901, the computational fluid analysis program 903, the design temperature calculating program 905, the wind-rose generating program 907, and the layout generating program 909 illustrated in FIG. 17A. These data 800 to 909 are stored into the storage section 12, as illustrated in FIG. 17A.

The weather predicting apparatus 90 may be connected to an external server 200 and computers 210 and 220 by a network 40. The computer 210 and the external server 200 may have the same components as those of the weather predicting apparatus 90. For example, the weather predicting apparatus 90 may receive the weather database 800 stored in the server 200 via the network 40. Alternatively, among the programs shown in FIG. 17A, only the weather analysis program 901, which concerns the weather simulations having a high system load, may be stored in the weather predicting apparatus 90, and the other programs may be stored in and executed by either of the computers 210 and 220.

Although the above-described weather predicting apparatus 90 is limited to computer hardware, the weather predicting apparatus 90 may instead be a virtual server of a data center. In such a case, the hardware configuration may be such that the programs 901 to 909 are stored in a storage section of the data center and executed by a processing section of the data center, and such that data is output from the data center to a client computer. The external server 200 may include a weather database. In such a case, the weather predicting apparatus 90 may receive the wide-area weather data from the external server 200.

[8] Reproduction of Weather Information Around LNG Production Facility

Figure 19A:
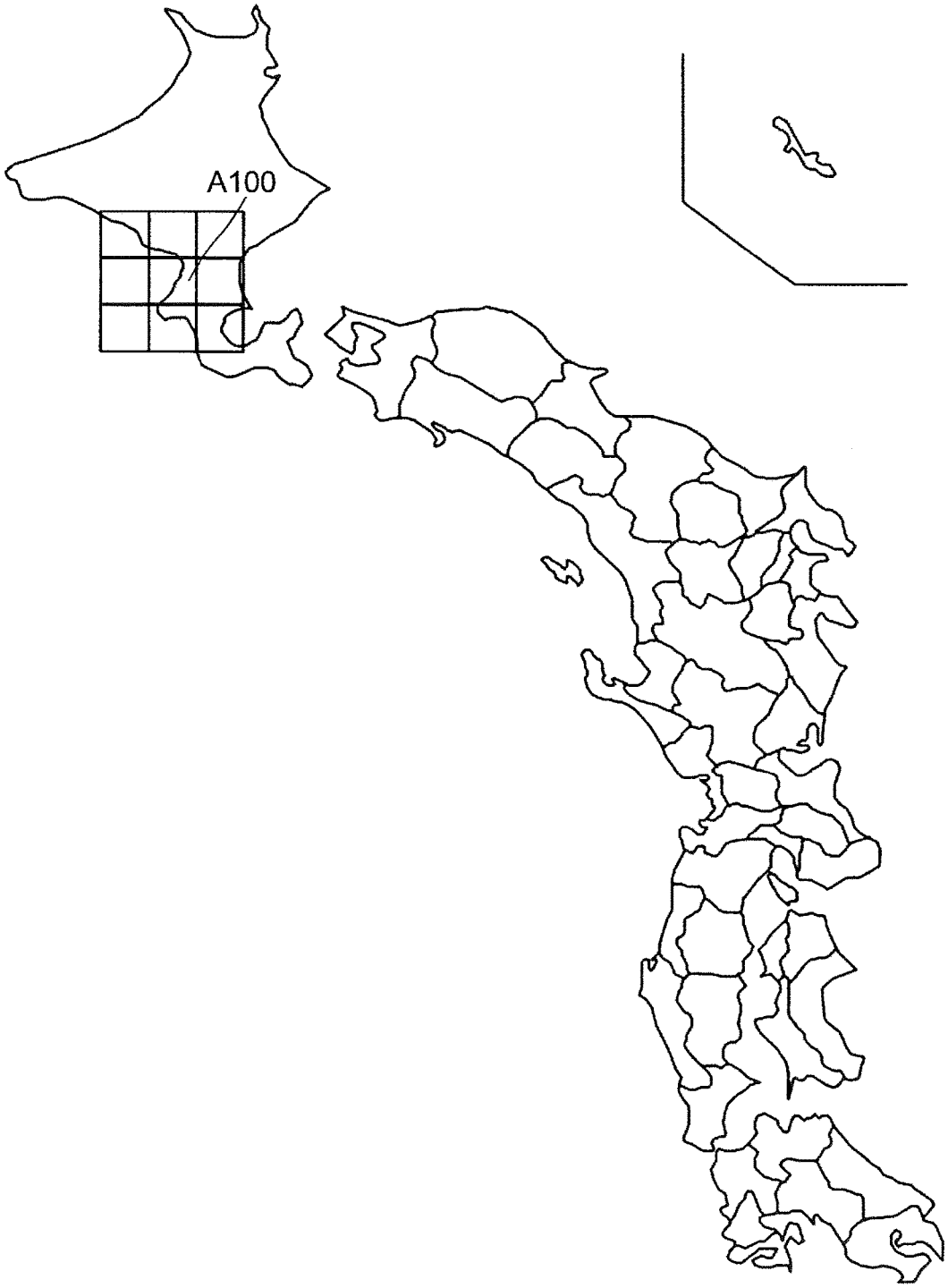
FIG. 19A illustrates an example of wide-area weather information.

FIG. 19A illustrates an example of wide-area weather information. In FIG. 19A, wide-area weather information A100 is shown on a map of Japan.

Figure 19B:
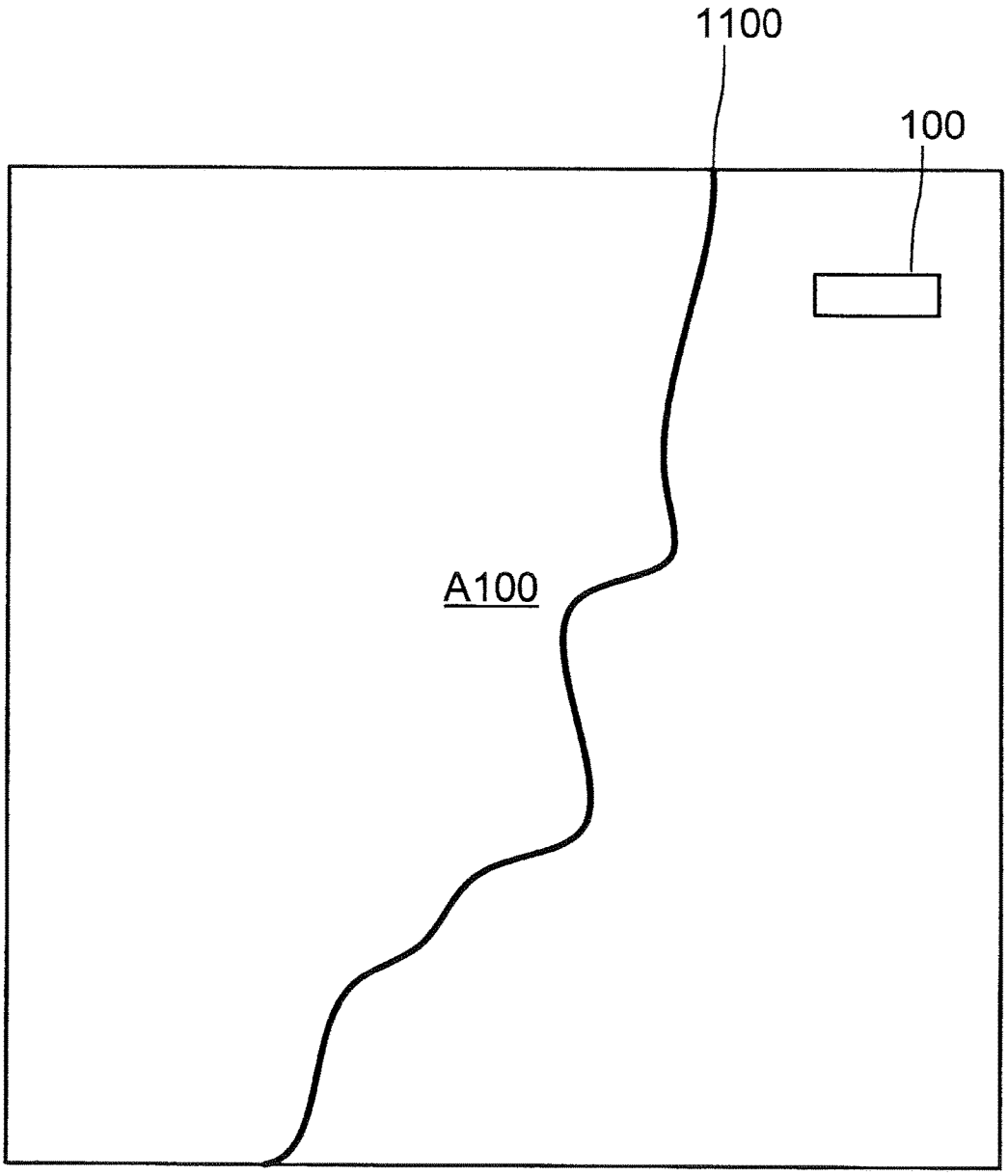
FIG. 19B illustrates an example in which the wide-area weather information illustrated in FIG. 19A is enlarged.

FIG. 19B illustrates an example in which the wide-area weather information illustrated in FIG. 19A is enlarged. An area in which the LNG production facility 100 is to be located is shown in the wide-area weather information A100 illustrated in FIG. 19B. Reference numeral 1100 denotes a coastline. The sea and the land are respectively on the left and right sides of the coastline 1100 in FIG. 19B.

Figure 20:
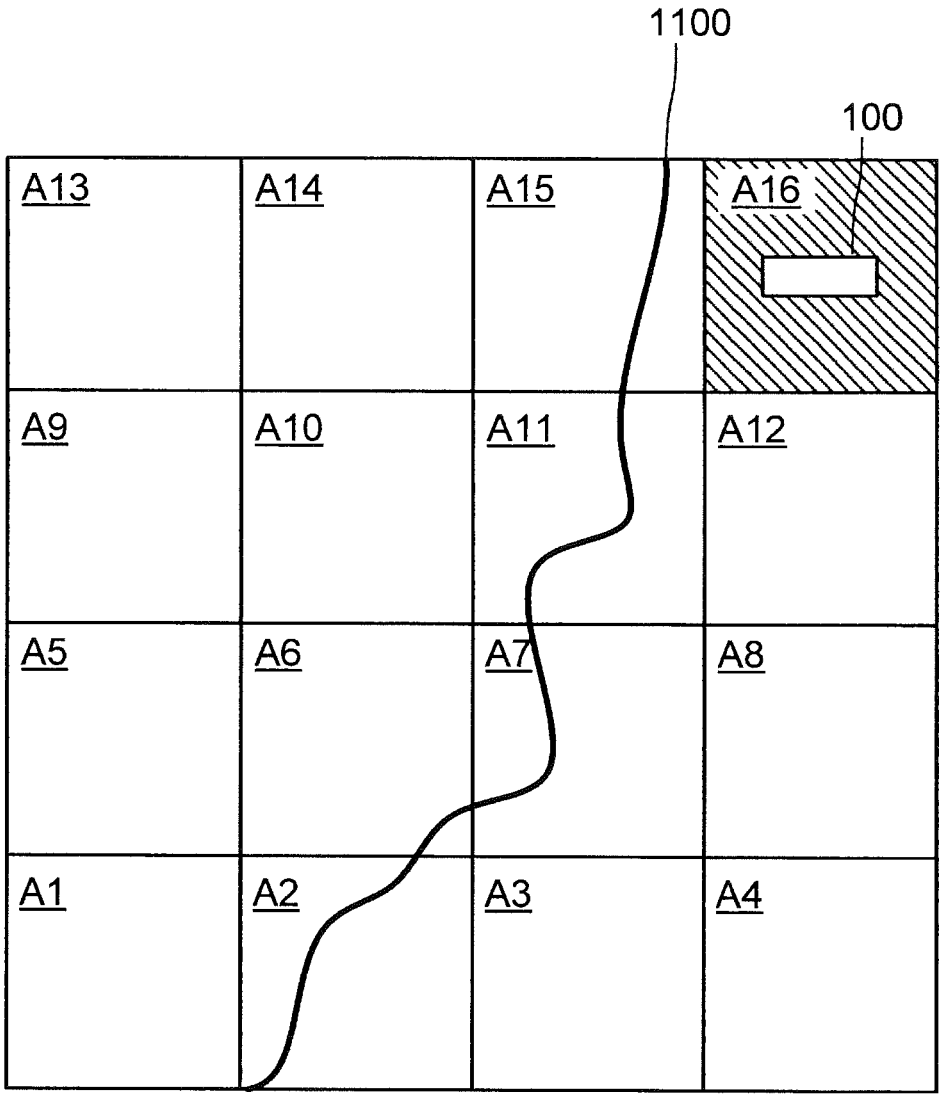
FIG. 20 illustrates an example of narrow-area weather information.

FIG. 20 illustrates an example of narrow-area weather information. FIG. 20 illustrates an area for which the weather simulations are performed. To perform the weather simulations, the area is divided into a plurality of areas A1 to A16, each of which corresponds to a calculation grid cell. For example, when the grid resolution is 9 km, the calculation area is 549 km×549 km. When the grid resolution is 1 km, the calculation area is 93 km×93 km. Accordingly, in these areas A1 to A16, estimation points are set in a grid pattern at intervals of 1 to 9 km in the north-south and east-west directions.

FIG. 20 illustrates the location of the LNG production facility 100. To obtain the temperature or the wind direction in this area, the processing section 12 generates narrow-area weather information A1 to A16 from the wide-area weather information A100 by solving partial differential equations of weather information based on weather analysis models.

Figure 21:
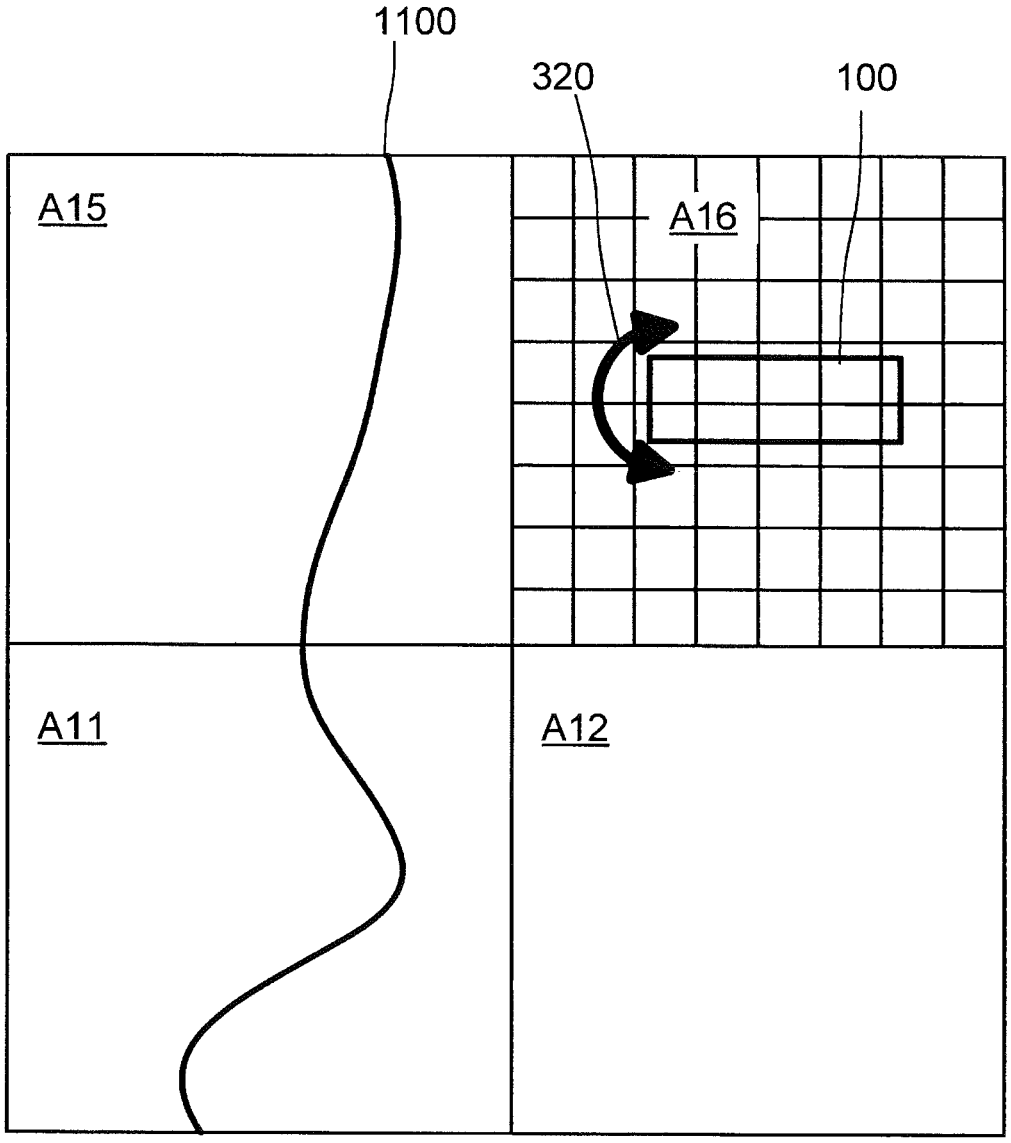
FIG. 21 illustrates an example of meteorological field information.

FIG. 21 illustrates an example of meteorological field information. The processing section 12 performs the computational fluid analysis on the narrow-area weather information A16 illustrated in FIG. 21 to calculate meteorological field information of areas smaller than the area of the narrow-area weather information. After calculation for the area A15 is performed, detailed meteorological field information of the area around the LNG production facility 100 may be determined by setting the meteorological field information of the area A15 as initial values and using fluid dynamic models (CFD models). In this case, the detailed meteorological field information can be determined with a resolution of 0.5 m, which is much higher than the grid resolution of the weather simulations (for example, 1 km).

The meteorological field information of the target area A16 in which the LNG production facility 100 is to be located can be determined by using fluid dynamic models. Thus, precise data that reflects the shape of the building and the like can be obtained. Examples of the fluid dynamic models include K·ε, LES, and DNS.

The calculation device according to the present embodiment is only required to acquire detailed data of meteorological field information of the target area. Therefore, it is not necessary to perform the CFD model analysis for all the areas A1 to A15. Accordingly, it is not necessary to spend a large amount of calculation time for the CFD model analysis. By performing only the CFD analysis for the target area, the precision can be increased and the processing time can be reduced.

In FIG. 21, reference numeral 320 denotes a recirculating flow of the exhaust gas. By performing the CFD analysis, the flow of the heated air discharged from the LNG production facility and recirculated into the suction unit of the LNG production facility, which cannot be clarified by the weather simulations, can be calculated and clarified. Additionally, since the recirculating flow is clarified, a suitable location of the LNG production facility can be determined.

When, for example, an airport or the like is located in the area A3 illustrated in FIG. 20 and necessary observation data, such as temperature data and wind direction data, is available, first narrow-area weather information sets may be recalculated by using such data as input values. In such a case, the precision of the weather simulations can be improved by using the local data that is available.

The topographical features of the area A16 in which the LNG production facility is to be located may be different from those included in the weather information as a result of land leveling, land use, or installation of equipment. In such a case, first narrow-area weather information sets may be recalculated on the basis of topographical information reflecting the effect of the land leveling, land use, or installation of equipment, depending on the arrangement of the LNG production facility. In this case, the weather conditions after the construction of the LNG production facility can be accurately simulated.

As described above, to design a liquefied gas production facility, the weather is predicted by the weather simulations, and the narrow-area weather information is generated. Based on these data, the CFD analyses illustrated in FIGS. 8, 10A to 10C, and 11A to 11C are performed, so that the arrangement of the LNG trains for preventing the external HAR can be determined. The LNG trains 1 and 2 are shifted from each other in the longitudinal direction so that the gas discharged from the LNG train 1, which is at the upstream side according to the wind direction data included in the narrow-area weather information sets, is not sucked in by the LNG train 2, which is at the downstream side according to the wind direction data included in the narrow-area weather information sets. Thus, the influence of HAR can be reduced.

Accordingly, even when data of multiple years is not available, a liquefied gas production facility with countermeasures against HAR can be designed and constructed.

The above-described embodiments are described merely as typical examples, and combinations, modifications, and variations of constituent features of each embodiment are apparent to a person skilled in the art. It is apparent that a person skilled in the art can make various changes to the above-described embodiments without departing from the principle of the present invention and the scope of the present invention described in the claims.

The entire contents of documents mentioned in this specification and the specification of the Japanese patent application to which this application claims priority under the Paris Convention are entirely incorporated by reference herein.

The invention claimed is:

1. A liquefied gas production facility comprising:

a plurality of liquefied gas producers which produce liquefied gas by removing an unnecessary substance and liquefying feed gas containing methane as a main component, wherein the plurality of liquefied gas producers comprise a first liquefied gas producer, a second liquefied gas producer, and a third liquefied gas producer, wherein the first and second liquefied gas producers are adjacent to each other, the second and third liquefied gas producers are adjacent to each other, and the second gas producer is arranged between the first and third gas producers, wherein each of the liquefied gas producers is rectangular and comprises:

a heat exchanger that cools the feed gas by causing the feed gas to exchange heat with a refrigerant;

a compressor that compresses the refrigerant that is evaporated as a result of the heat exchange with the feed gas, an air fin cooler unit that cools the compressed refrigerant, the air fin cooler unit being rectangular and comprising a plurality of air fin coolers that are arranged along at least one straight line; and an expander that cools the cooled refrigerant through adiabatic expansion, wherein, in the each of the liquefied gas producers, each of the heat exchanger, the compressor, and the expander is arranged at a side of the air fin cooler unit in a longitudinal direction of the air fin cooler unit, wherein the first and second liquefied gas producers are shifted from each other in a longitudinal direction of the first liquefied gas producer, wherein a first ratio X/L of a distance (X) to a length (L) is equal to or greater than 0.2, the distance (X) being a longitudinally shifted distance of the second liquefied gas producer and the length (L) being a longitudinal length of the first liquefied gas producer, wherein the plurality of air fin coolers in the second liquefied gas producer comprise a propane subcooler that is disposed at the opposite side of the direction in which the second liquefied gas producer is shifted, wherein the second and third liquefied gas producers are shifted from each other in the longitudinal direction of the first liquefied gas producer, wherein a second ratio X/L of a distance (X) to a length (L) is equal to or greater than 0.2, the distance (X) being a longitudinally shifted distance of the third liquefied gas producer and the length (L) being a longitudinal length of the second liquefied gas producer, and wherein the second and third liquefied gas producers are arranged in a lateral direction of the first liquefied gas producer.

2. The liquefied gas production facility according to claim 1, wherein hot air discharged from the air fin cooler unit of the first liquefied gas producer does not accumulate in a space between the air fin cooler unit of the first liquefied gas producer and the air fin cooler unit of the second liquefied gas producer.

3. The liquefied gas production facility according to claim 1, wherein the first ratio X/L is equal to or greater than 0.5.

4. The liquefied gas production facility according to claim 1, wherein the first ratio X/L is equal to or greater than 0.6.

5. The liquefied gas production facility according to claim 1, wherein each of the liquefied gas producers is provided with a utility facility that is arranged at a side of each of the liquefied gas producers in a direction opposite to the direction in which the second liquefied gas producers is shifted.

6. The liquefied gas production facility according to claim 1, wherein a plurality of weather information sets are selected from a plurality of items of weather information which are related to areas and times and which include at least temperature data, the plurality of weather information sets being related to a plurality of times over a fixed period concerning a first area containing a location at which the liquefied gas producers are placed, wherein a plurality of first narrow-area weather information sets related to a plurality of second areas which are disposed within the first area and which are smaller than the first area are generated by solving, with the use of the selected plurality of weather information sets as input data, differential equations expressing the weather information based on analysis models used for conducting weather simulations, wherein a second narrow-area weather information set concerning a second area containing the location of the liquefied gas producers is selected from among the generated plurality of first narrow-area weather information sets, and wherein, by using wind direction data included in the second narrow-area weather information set, the first and second liquefied gas producers are arranged so as to be shifted from each other in the longitudinal direction of the first liquefied gas producer so that gas discharged from the first liquefied gas producer, which is at an upwind side according to the wind direction data included in the second narrow-area weather information set, is not sucked in by the second liquefied gas producer, which is at a downwind side according to the wind direction data included in the second narrow-area weather information.

* * * * *